US011112205B1

(12) United States Patent
Kempf et al.

(10) Patent No.: US 11,112,205 B1
(45) Date of Patent: Sep. 7, 2021

(54) PROJECTILE LAUNCHING DEVICE WITH SELF-TIMING AND WITHOUT CAM LEAN

(71) Applicant: Archery Innovators, LLC, Tiffin, IA (US)

(72) Inventors: James J. Kempf, Coralville, IA (US); Rex E. Isenhower, Stanwood, IA (US)

(73) Assignee: ARCHERY INNOVATORS, LLC, Tiffin, IA (US)

( * ) Notice: Subject to any disclaimer, the term of this patent is extended or adjusted under 35 U.S.C. 154(b) by 0 days.

(21) Appl. No.: 17/148,628

(22) Filed: Jan. 14, 2021

Related U.S. Application Data

(60) Provisional application No. 62/967,651, filed on Jan. 30, 2020.

(51) Int. Cl.
*F41B 5/12* (2006.01)
*F41B 5/10* (2006.01)

(52) U.S. Cl.
CPC ..... *F41B 5/105* (2013.01); *F41B 5/123* (2013.01)

(58) Field of Classification Search
CPC ..... Y10S 124/90
USPC ..... 124/25.6, 25, 900
See application file for complete search history.

(56) References Cited

U.S. PATENT DOCUMENTS 4,457,288 A * 7/1984 Ricord ..... F41B 5/10 124/25.6
6,776,148 B1 * 8/2004 Islas ..... F41B 5/10 124/25.6
7,637,256 B2 * 12/2009 Lee ..... F41B 5/10 124/25.6
8,037,876 B1 * 10/2011 Yehle ..... F41B 5/105 124/25.6
8,387,603 B2 * 3/2013 Darlington ..... F41B 5/12 124/25.6
8,443,791 B2 * 5/2013 Miller ..... F41B 5/10 124/25.6
8,651,095 B2 * 2/2014 Islas ..... F41B 5/123 124/25
8,826,894 B1 * 9/2014 Darlington ..... F41B 5/105 124/25.6
9,234,719 B1 * 1/2016 Kempf ..... F41B 5/123
9,243,861 B1 * 1/2016 Kempf ..... F41B 5/12
9,297,604 B1 * 3/2016 Sidebottom ..... F41B 5/12
9,377,267 B1 * 6/2016 Kempf ..... F41B 5/123
9,494,379 B2 * 11/2016 Yehle ..... F41B 5/066
9,513,080 B1 * 12/2016 Kempf ..... F41B 5/1411
9,671,189 B2 * 6/2017 McPherson ..... F41B 5/123
9,759,509 B1 * 9/2017 Kempf ..... F41B 5/123
9,829,268 B1 * 11/2017 Kempf ..... F41B 5/123
10,048,036 B1 * 8/2018 Kempf ..... F41B 5/123
10,267,592 B2 * 4/2019 Bartels ..... F41B 5/123
(Continued)

*Primary Examiner* — Alexander R Niconovich
(74) *Attorney, Agent, or Firm* — Donald J. Ersler

(57) ABSTRACT

A projectile launching device includes self-timing without cam lean. The projectile launching device may include a frame, energy storing components, (such as two limbs), two cams, a launch string, and at least two cables. The ends of the launch string are attached to the two cams. Opposing ends of first and second cables are coupled to the first and second cams. A mid-portion of the first and second cables are slide-ably engaged with the first and second cable pulleys, respectively. The two cams are built as mirror images of each other, each cam having a cable payout track, a bowstring track, and a cable take-up track.

18 Claims, 22 Drawing Sheets

(56) References Cited

U.S. PATENT DOCUMENTS

| | | | | |
|---|---|---|---|---|
| 10,458,742 | B1 * | 10/2019 | Kempf | F41B 5/123 |
| 10,473,418 | B2 * | 11/2019 | Shaffer | F41B 5/123 |
| 10,514,226 | B2 * | 12/2019 | Shaffer | F41B 5/1449 |
| 10,520,274 | B2 * | 12/2019 | Bartels | F41B 5/123 |
| 10,767,956 | B2 * | 9/2020 | Popov | F41B 5/123 |
| 10,989,491 | B2 * | 4/2021 | McPherson | F41B 5/10 |
| 10,989,492 | B1 * | 4/2021 | Kempf | F41B 5/105 |
| 11,022,398 | B1 * | 6/2021 | Kempf | F41B 5/105 |
| 2017/0268846 | A1 * | 9/2017 | Dziekan | F41B 5/123 |
| 2018/0135935 | A1 * | 5/2018 | McPherson | F41B 5/10 |
| 2018/0224237 | A1 * | 8/2018 | McPherson | F41B 5/10 |
| 2018/0231345 | A1 * | 8/2018 | McPherson | F41B 5/123 |
| 2019/0257610 | A1 * | 8/2019 | Ozanne | F41B 5/105 |

* cited by examiner

PROJECTILE LAUNCHING DEVICE WITH SELF-TIMING AND WITHOUT CAM LEAN

CROSS REFERENCE TO RELATED APPLICATIONS

This is a utility patent application, which claims the benefit of and incorporates by reference in its entirety, provisional application No. 62/967,651, filed on Jan. 30, 2020.

BACKGROUND OF THE INVENTION

Field of the Invention

The present invention relates generally to archery and more specifically to a shooting bow with a unique cable arrangement, which allows a portion of first and/or second cables to be slide-ably engaged to a first and second pulley, and the ends of each cable are anchored to the same cam. This arrangement enables the device to have self-timing. The present invention may alternately use components other than flexible limbs for storing energy prior to launching the projectile.

Discussion of the Prior Art

Historically, archery bows and crossbows have been used for war, survival, sport, and recreation. A specific component of a compound style shooting bow are the cables. Typically, each cable includes a power end and a control end. The manner in which the cables interact with the cams and limbs of the bow is of particular importance. Typically, the power end of the cable is coupled to the cam on one limb, and the control end of the cable is often coupled to the opposite limb or opposite cam. A very good way to accomplish efficiency is through a binary cam system, wherein the cables are connected to opposing cams, and as one of the cams wraps the cable on the power track, the opposite cam pays out cable from the control track. While all of these methods work to some extent, all have significant issues with performance related to cam lean, and/or assembly and cost. Due to the crossing of cables and the need to keep the cables from interfering with the flight of the arrow, the cables often are off-angle, which in turn creates twisting and torque in a cam axle, thus creating cam lean.

U.S. Pat. No. 4,457,288 to Ricord discloses a cam lever compound bow, where a bow utilizes single string wrapping pulleys journaled to the ends of the bow limbs, and the ends of the string are coupled to a cam device mounted upon the bow riser. Although, this method does remove the problem of the cables being in the way, it is very inefficient, and timing issues from one limb to the other is a factor. U.S. Pat. No. 7,637,256 to Lee discloses a compound bow, which provides a shooting bow that removes the issue of cables interfering with the flight of the arrow. However, the inefficient use of tensioning devices severely limits the potential of this device. U.S. Pat. No. 8,651,095 to Islas discloses a bowstring cam arrangement for compound crossbow, which provides a method of removing the cables from the path of the string. U.S. Pat. No. 9,494,379 to Yehle discloses a crossbow, where Yehle relies on four cables. Issues are created by having separate cables above and below the string track on each cam. If the cables are not of exact length, or if the upper cable stretches more than the lower cable, or visa-versa, the cables must be adjusted by the user to stay in time with each other. Timing of the cables can be a time consuming and a very difficult process. U.S. Pat. No. 9,759,509 to Kempf teaches a cable configuration wherein the cables are not anchored to the cams, which allows for self-timing. More recently, Hoyt introduced a cable configuration wherein the ends of the cable are anchored to the cam, and a central portion of the cable passes through a sleeve. This system is beneficial, however still lacks the smooth passage of the cables to self-time, further there is no provision for the cams to rotate more than about 180 degrees. The present invention deals with the manner in which the cables are coupled to the cams of the bow or crossbow.

Prior art known as heli-coil style cams are limited in controlling the limb tip movement (LTM) or axle to axle movement (A-AM) which, in that LTM and A-AM is directly prescribed by the perimeter of the cable take-up tracks on the cams. Due to structural requirements placed upon the cams and the diameter of the required component axles that the take-up track must wind, the perimeter of the cable take-up track has always been a limiting factor when attempting to create a very low LTM/A-AM. In all prior art, the lowest LTM/A-AM is 3.5 inches total movement, or 1.75 inches of movement per side. The lesser the distance of movement, the more efficient the bow becomes, the faster the cams will rotate, and faster the projectile speed results.

Accordingly, there is a clearly felt need in the art to provide a shooting bow, which allows a mid-portion of first and second cables to be slidably engaged on a first and second pulley, and the ends of the cables are coupled to the same cam, respectively, wherein the cam is allowed to rotate at least 200 degrees, up to at least 360 degrees. The cables do not cross the centerline of the shooting bow. Additionally, the cams are allowed to rotate 360 degrees due to a wider upper and lower cable track, or alternately a divided helical cable track, which allows the cable to wrap adjacent to itself. Finally, there is a clearly felt need in the art to provide a shooting bow having very low LTM/A-AM.

SUMMARY OF THE INVENTION

The present invention provides a self-timing cam and cable configuration for a projectile launching device. The present invention includes a pair of cables, wherein both ends of the same cable anchors to the same cam(s), and also reduces or eliminates cam lean. The projectile launching device with self-timing and without cam lean (projectile launch device) may be applied to either a crossbow or vertical bow. The projectile launch device preferably includes a first cam, a second cam, a launch string and two cables, collectively known as a harness system. This configuration allows opposing ends of a first cable to be anchored to a first cam, and opposing end of a second cable to be anchored to a second cam. Preferably, the first and second cables do not cross a centerline of the shooting bow. In a second preferred embodiment, the projectile launching device preferably includes a string latch housing, a bow riser, a rail, a first energy storing device (such as a first limb), a second energy storing device (such as a second limb), a first cam, a second cam, at least one bowstring, and two cables.

The term "limb" may refer to what are known as solid limbs, split-limbs, tube-limbs, or any other flexible energy storing component. The bow riser is enjoined with the rail. One end of the first limb extends from a first end of the bow riser and one end of the second limb extends from a second end of the bow riser. The first cam is pivotally retained on the first limb and the second cam is pivotally retained on the second limb. A first end of the launch string is retained by the first cam and a second end of the launch string is retained by the second cam. On an alternative embodiment, a first set of first and second cable posts are located on a first side of a centerline of the rail and a second set of first and second cable posts are located on a second side of the centerline of the rail. These cable posts may be used to anchor a secondary set of cables which support the cable pulleys. The first cam includes a first cam launch string track, an upper first cam cable track, located above the launch string track, and a lower first cam cable track, located below the launch string track. The second cam includes a second cam launch string track, an upper second cam cable track, located above the launch string track, and a lower second cam cable track, located below the launch string track. The first set of first and second cable posts are located above the plane of the launch string, and the second set of first and second cable posts are located below the plane of the launch string.

A first end of the first cable is coupled to the first cable first cable post; a segment of the first cable before a middle of the first cable partially engages the first cable pulley; the middle of the first cable partially wraps the first cable pulley; a segment of the first cable after the middle of the first cable partially engages the first cam second cable track; and a second end of the first cable is coupled to the first cable second cable post. A first end of the second cable is coupled to the second cable first cable post; a segment of the second cable before a middle of the second cable partially engages the second cam first cable track; the middle of the second cable partially wraps the second cable pulley; a segment of the second cable after the middle of the second cable partially engages the second cam second cable track; and a second end of the second cable is coupled to the second cable second cable post.

When the launch string is drawn from a rest position to a ready to fire position, the first cam rotates in a first direction and the second cam rotates in a second direction. As the first and second cams rotate, the launch string is unwound from the first and second launch string tracks. Simultaneously, the first and second cables wind into the first and second cable tracks of the first and second cams.

A unique feature of the present invention is that both ends of the first and second cables are firmly fixed to the same cam, and the middle portions "float" or slide relative to the first and second cable pulleys. The first and second cables are of one piece, and as the cable stretches, it self-centers itself about the cable pulleys.

Another unique feature of the present invention is the ability of the cam to rotate a full 360 degrees, such that as the cams are rotating, the upper and lower cable portions wrap the cable cams.

The present invention as a continuation discloses a first and second cam that are mirror images of themselves, the cams have a string track, a first cable payout track on a first side of the string track, and a first cable take-up track on the second side of the string track. A first cam is journaled on a first side of a bow center-line, and a second cam is journaled on a second side of a bow center-line. A first end of a bowstring is anchored to the first cam, a segment of the bowstring at least partially wraps the first cam string track and spans to the second cam, a segment of the bowstring at least partially wraps the second cam, and a second end of the bowstring is anchored to the second cam. A first end of a first cable is anchored to a first cable post on the first cam, a payout segment of the first cable at least partially wraps the payout cable track of the first cam, the cable spans to and at least partially wraps the first pulley or hub, then the first cable spans to at least partially engage the first cable take-up track of the first cam, and the second end of the first cable is anchored to a second cable post on the first cam.

A first end of a second cable is anchored to a first cable post on the second cam, a payout segment of the second cable at least partially wraps the payout cable track of the second cam, the cable spans to and at least partially wraps the second pulley or hub, then the second cable spans to at least partially engage the second cable take-up track of the second cam, and the second end of the second cable is anchored to a second cable post on the second cam. In a preferred embodiment, the cables do not cross the center line of the bow, however in an alternative embodiment, the cables may cross the center line of the bow. The perimeter of the payout cable track must be sized smaller than the perimeter of the cable take-up track.

The arrangement of the cams, string, cables, and limbs may be of any known in the art, such as reverse draw with inverted cams (bowstring to front of cam), reverse draw limbs with standard cams (bowstring to rear of cams), standard draw limbs with inverted cams, standard draw limbs with standard cams, limbs having mid-mounted cams. Further, the limbs may be replaced by any force storing component known in the art, such as tubes, springs, and the like.

Unique to the present invention, as the bowstring is pulled, the cams rotate a first direction unwinding the bowstring from the bowstring track, the cable payout track unwinds cable (pays out) and the cable take-up track winds the cable, creating increased energy in the limbs or springs, and is also known as limb tip movement. Limb tip movement (LTM) is the distance the limb tips move from a static position, wherein the bow is at rest, to a loaded position, wherein the bow is cocked. The smaller the LTM, the faster the cams rotate, and the less shock created in the bow when the bow the energy is released.

The perimeter of the cable payout track (CPT) must be sized smaller than the perimeter of the cable take-up track (CTT). Such a requirement allows for manipulation of the LTM based on a ratio of CPT:CTT, in that a ratio of 1:1 would result in zero inches LTM; a CPT measurement of 1 inches and a CTT of 4 inches has a ratio of 1:4, or LTM of 3 inches. The same CTT and a CPT of 2 inches has a ratio of 2:4 and has an LTM of 2 inches. The present invention may have a fixed style CPT or modular style CPT, the latter style having interchangeable CPT allowing for multiple peak energy forces without the need to change limbs, string, or cables. An example would be a small perimeter CPT would allow for greater LTM and an increased limb deflection and peak energy as compare to a CPT having a larger perimeter and decreased LTM and lower limb deflection and peak energy.

Prior art using a standard cam/cable track configuration without cable payout, if the perimeter of the cable track is 3 inches, the LTM will be 3 inches. Prior art using binary cams where there is cable payout, a cable track of 4 inches and a cable payout of 1.5 inches would create an LTM of 2.5 inches, however binary cams can not rotate over about 180 degrees.

In certain embodiments, the cams may be designed having zero let-off, or any amount of desired let-off. The cams may be designed having no adjustability for draw length modules, or may have draw length adjustability modules. The cams may have cable tracks more or less parallel to the string track, not parallel to the string track, or helical about the axis of the cam axle. The cams may be journaled with the limbs, tubes, or springs (non-stationary), or the limbs may be journaled with the frame (stationary) wherein the cables interact with the limbs.

In a preferred embodiment, the launch string may be releasably retained in the ready-to-fire position by mechanisms known as a string latch assembly or a string release.

In a first preferred alternative embodiment, the launch string may be held in the ready-to-fire position and released by the users' fingers.

In a second preferred alternative embodiment, a rail-less crossbow design may be used.

In a third preferred alternative embodiment, the same harness system configuration may be used on projectile launching devices utilizing energy storing components other than flexible limbs. These other types of energy storing components include spring(s), hydraulics, or pressurized cylinder(s).

For clarity, the word coupled is being defined as a way to connect an object, such as a bowstring or cable, with another object, be it directly or indirectly, such as directly to a post or pulley, or indirectly as in from the end of a string or cable, to an intermediate object, and then to a limb or axle.

Accordingly, there is a clearly felt need in the art for a projectile launching device with no cam lean, having a first cam, a second cam, a launch string and at least two cables, collectively known as a harness system, where neither both ends of the same cable are rigidly attached to the same cam, and the mid-portion of each cable at least partially wraps a cable pulley.

These and additional objects, advantages, features and benefits of the present invention will become apparent from the following specification.

DETAILED DESCRIPTION OF THE PREFERRED EMBODIMENTS

Figure 1A:
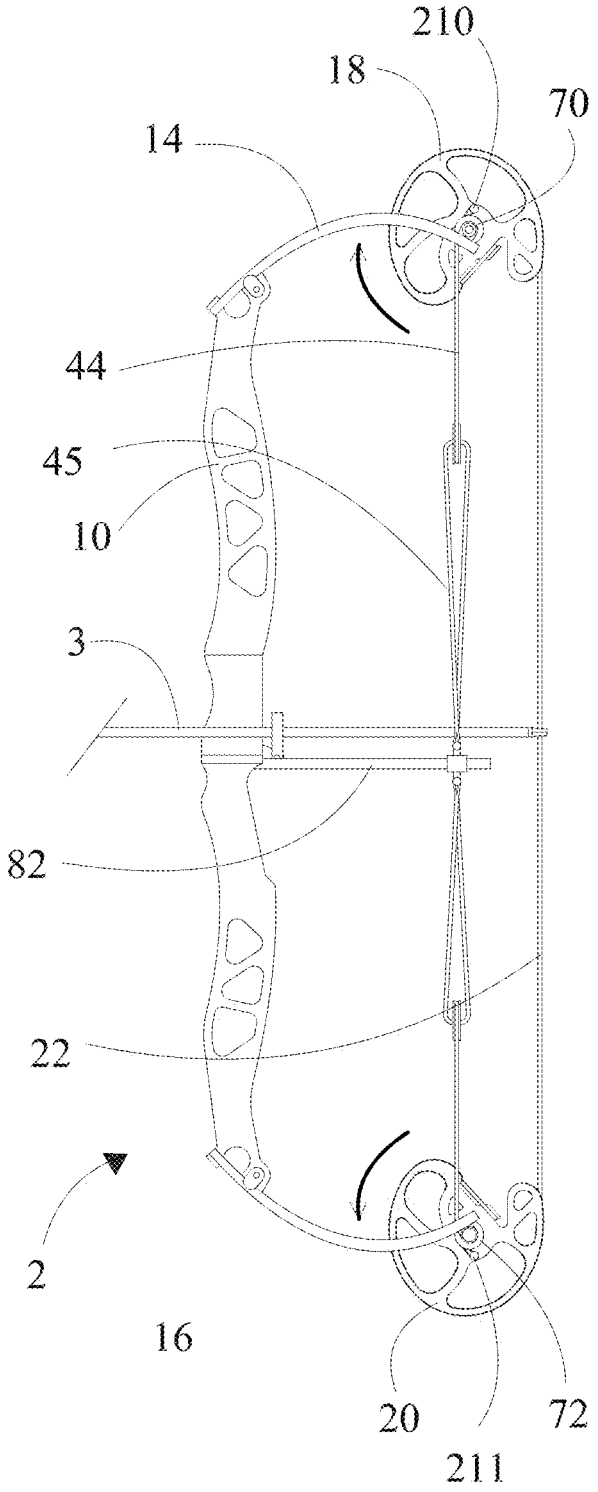
FIG. 1A is a partial rear view of a vertical bow of the present invention, having a first and second cam, a first and second cable, and a string, wherein opposing ends of the same cable are anchored to the same cam, and a mid-portion of the cables partially wrap a cable pulley.
Figure 1B:
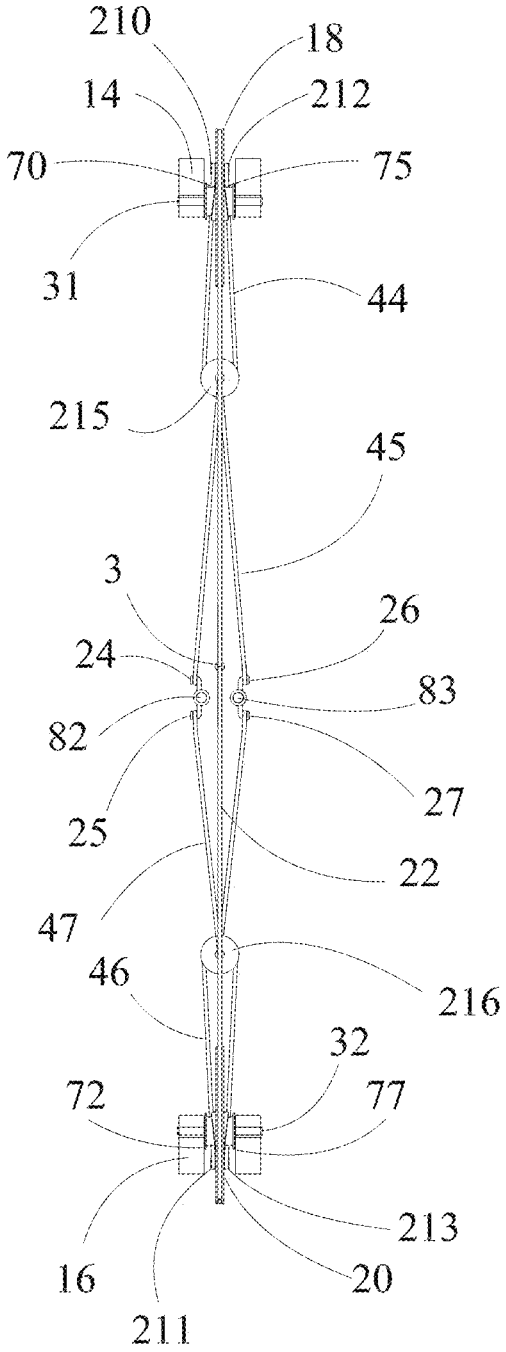
FIG. 1B is a partial rear view of a vertical bow of the present invention, having a first and second cam, a cable, and a string, wherein opposing ends of the same cable are anchored to the same cam, and a mid-portion of the cables partially wrap a cable pulley.

With reference now to the drawings, FIGS. 1, 1A and 1B show views of a vertical bow-type projectile launching device 2. The projectile launching device 2 preferably includes a bow riser 10, a first limb 14, a second limb 16, a first cam 18, a second cam 20 and a launch string 22. One end of the first limb 14 is attached to a first end of the bow riser 10 and one end of the second limb 16 is attached to a second end of the bow riser 10. The first cam 18 is pivotally retained on an opposing end of the first limb 14 with a first axle 31 and the second cam 20 is pivotally retained on an opposing end of the second limb 16 with a second axle 32.

With more specific reference to FIG. 1A, the disclosed embodiment illustrates a vertical bow 2 having a first cable 44 and a second cable 46, wherein a first end of the first cable 44 is anchored to a first cable first post 210, and a second end of the first cable 44 is anchored to a first cable second cable post 212. A first end of the second cable 46 is anchored to a second cable first cable post 211 and a second end of the second cable 46 is anchored to a second cable second post 213. A first cable spanner bar 82 is coupled to the riser 10 on a first side of the launch string 22, and a second cable spanner bar 83 is coupled to the riser 10 on a second side of the launch string 22. The cable spanner bars 82 and 83 displace the first and second pulley mounting cables 45 and 47 a distance away from the launch string 22 to allow clearance for an arrow 33.

More specifically referring to FIG. 1B, the disclosed embodiment illustrates a vertical bow 2. The first spanner bar 82 is coupled to the riser 10 on the first side of the launch string 22, and the second spanner bar 83 is coupled to the riser 10 on the second side of the launch string 22. A first end of a first cable 44 is coupled to a first cam 18 first cable anchor 210, a mid-portion of said first cable partially wraps a first cable pulley 215, and a second end of said first cable anchors to a first cam 18 second cable post 212. A first end of a second cable 46 is coupled to a second cam 20 first cable anchor 211, a mid-portion of said second cable 46 partially wraps a second cable pulley 216, and a second end of said second cable 46 anchors to a second cam 18 second cable post 213. The first cable pulley 215 is coupled to a first pulley mounting cable 45 and first and second first pulley mounting cable post 24 and 26. The second cable pulley 216 is coupled to a second pulley mounting cable 47 and first and second second-pulley mounting cable post 25 and 27.

Figure 2A:
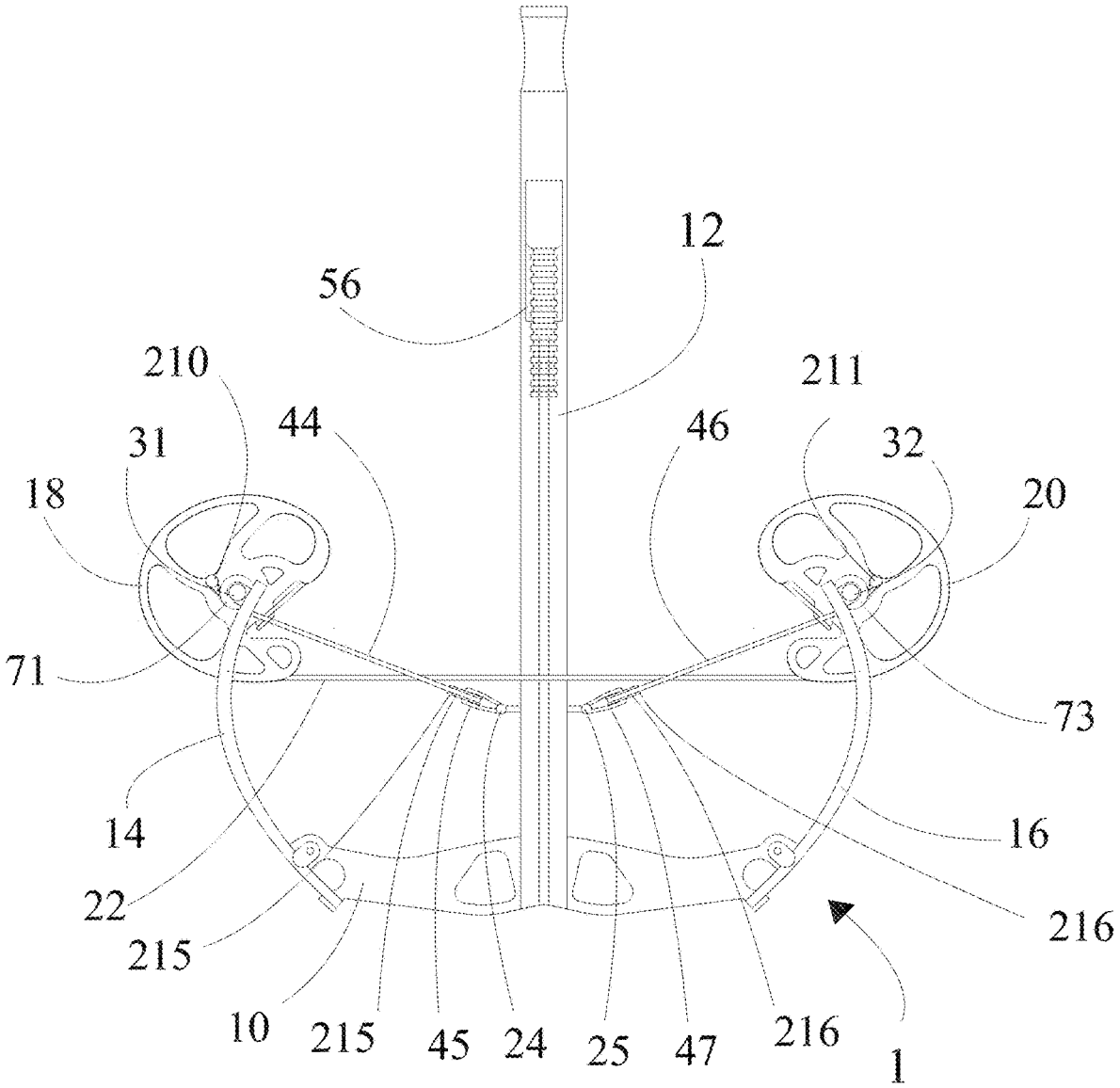
FIG. 2A is a top view of a conventional limb crossbow with inverted cams of the present invention in an at-rest position, having first and second cams; first and second cables; and a string, wherein opposing ends of the same cable are anchored to the same cam, and a mid-portion of the cables partially wrap a cable pulley.
Figure 2B:
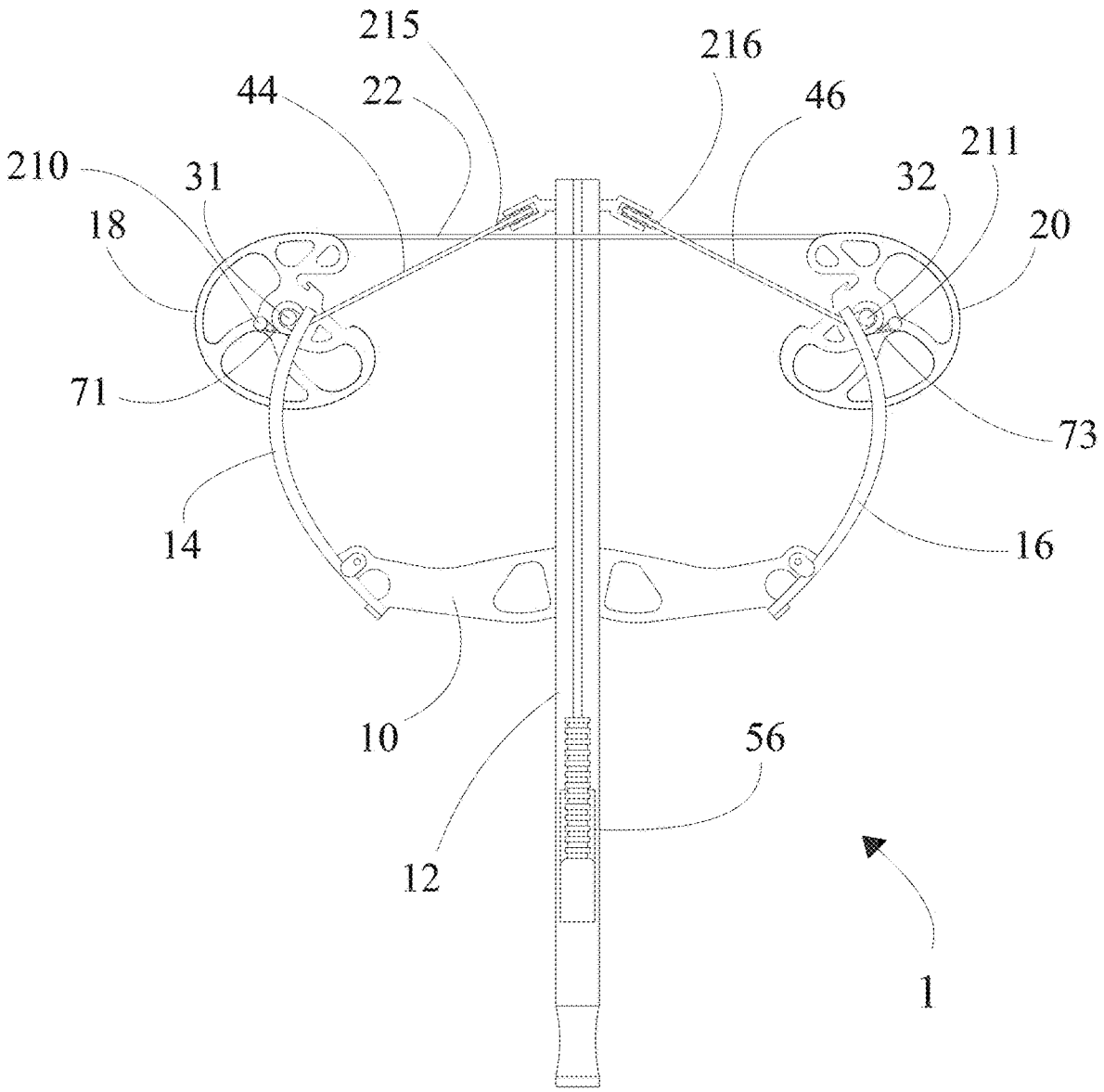
FIG. 2B is a top view of a reverse draw crossbow of the present invention in an at-rest position, having first and second cams; first and second cables; and a string, wherein opposing ends of the same cable are anchored to the same cam, and a mid-portion of the cables partially wrap a cable pulley.

FIGS. 2A and 2B illustrate a crossbow 1 of the current invention. The bow riser 10 may be joined with the rail 12 in any method known to join two pieces, as well as the rail 12 and the riser 10 being formed together as a single unit. The projectile launching device 1 preferably includes the riser 10, the rail 12, a first limb 14, a second limb 16, a first cam 18, a second cam 20 and a launch string 22.

A first end of the first limb 14 is coupled to a first end of the bow riser 10 and a first end of the second limb 16 is coupled to a second end of the bow riser 10. The first cam 18 is pivotally retained on an opposing end of the first limb 14 and the second cam 20 is pivotally retained on an opposing end of the second limb 16. The crossbow 1 includes a first cable 44 and a second cable 46. With reference to FIGS. 2A and 2B, the first end of the first cable 44 is anchored to the first cable first post 210, and the second end of the first cable 44 is anchored to the first cam second cable post 212. The first end of the second cable 46 is anchored to the second cable first cable post 211, and the second end of the second cable 46 is anchored to the second cable second post 213.

The first end of the first pulley mounting cable 45 is coupled to a first cable pulley 215 and a first pulley mounting cable first and second post 24 and 26 (26 not shown). The first end of the second pulley mounting cable 47 is coupled to a second cable pulley 216 and a second pulley mounting cable first and second post 25 and 27 (27 not shown).

Figure 2C:
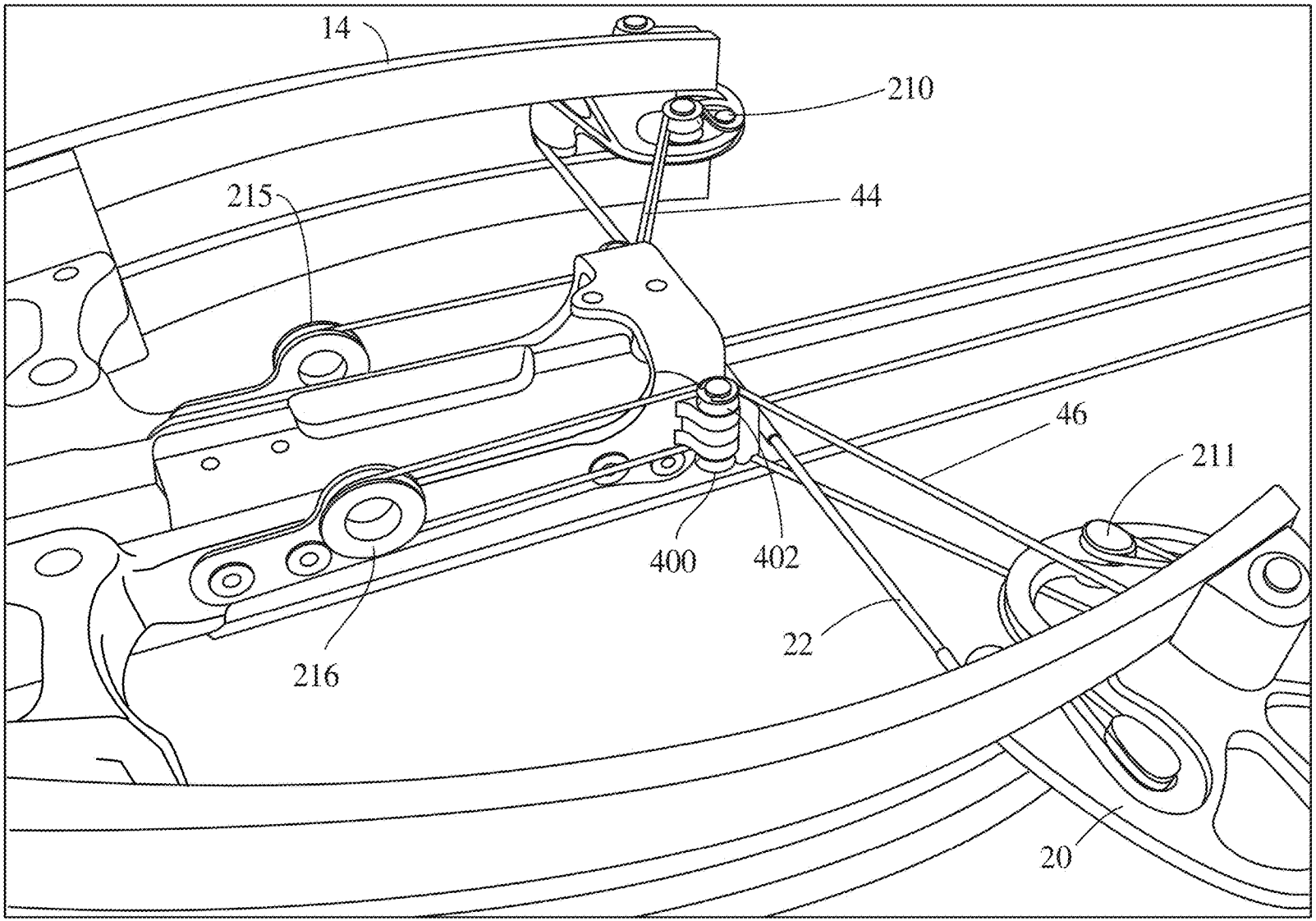
FIG. 2C is a partial view of the cable configuration of a crossbow of the present invention.
Figure 2D:
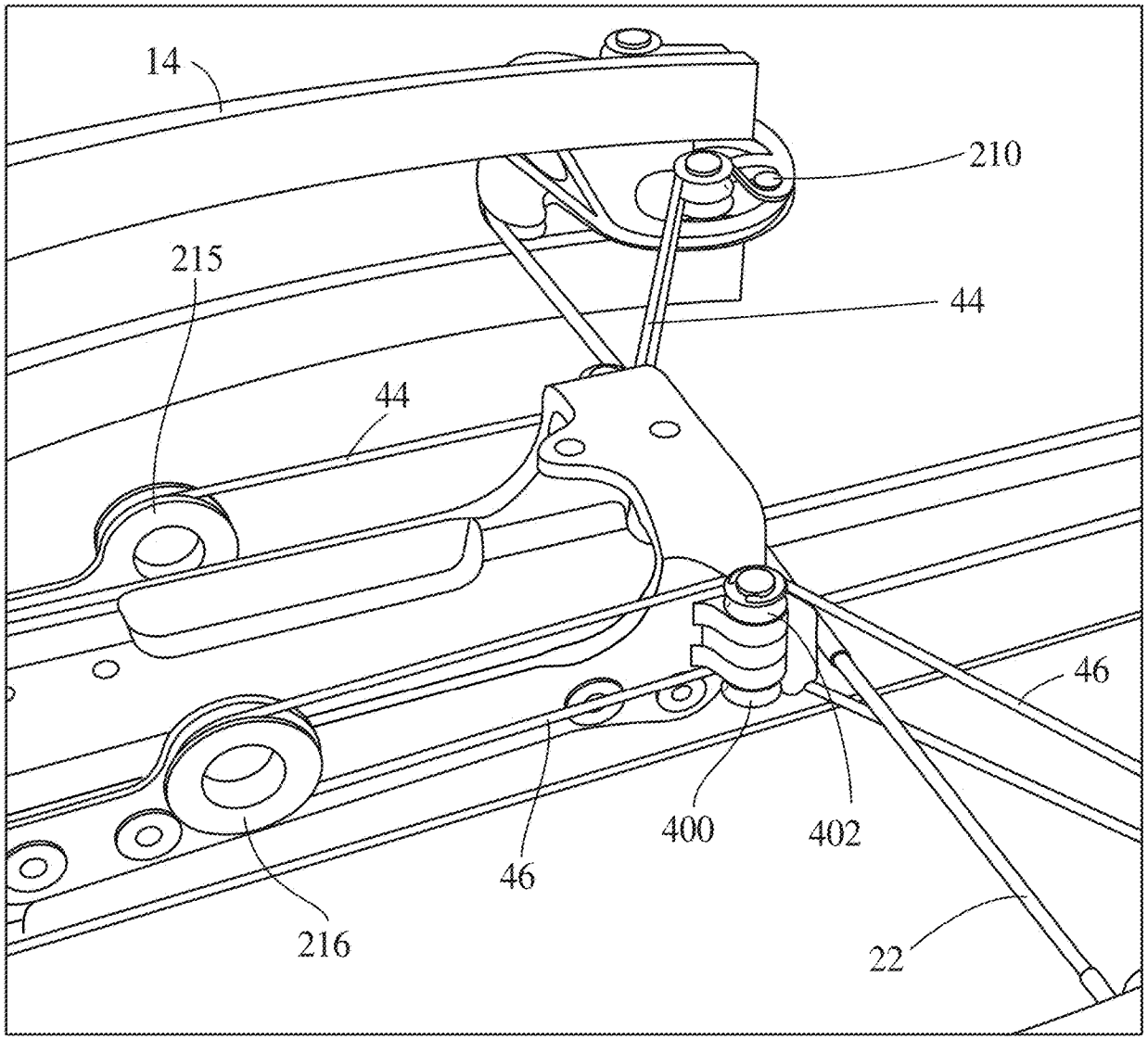
FIG. 2D is a partial view of the cable configuration of a crossbow of the present invention.
Figure 2E:
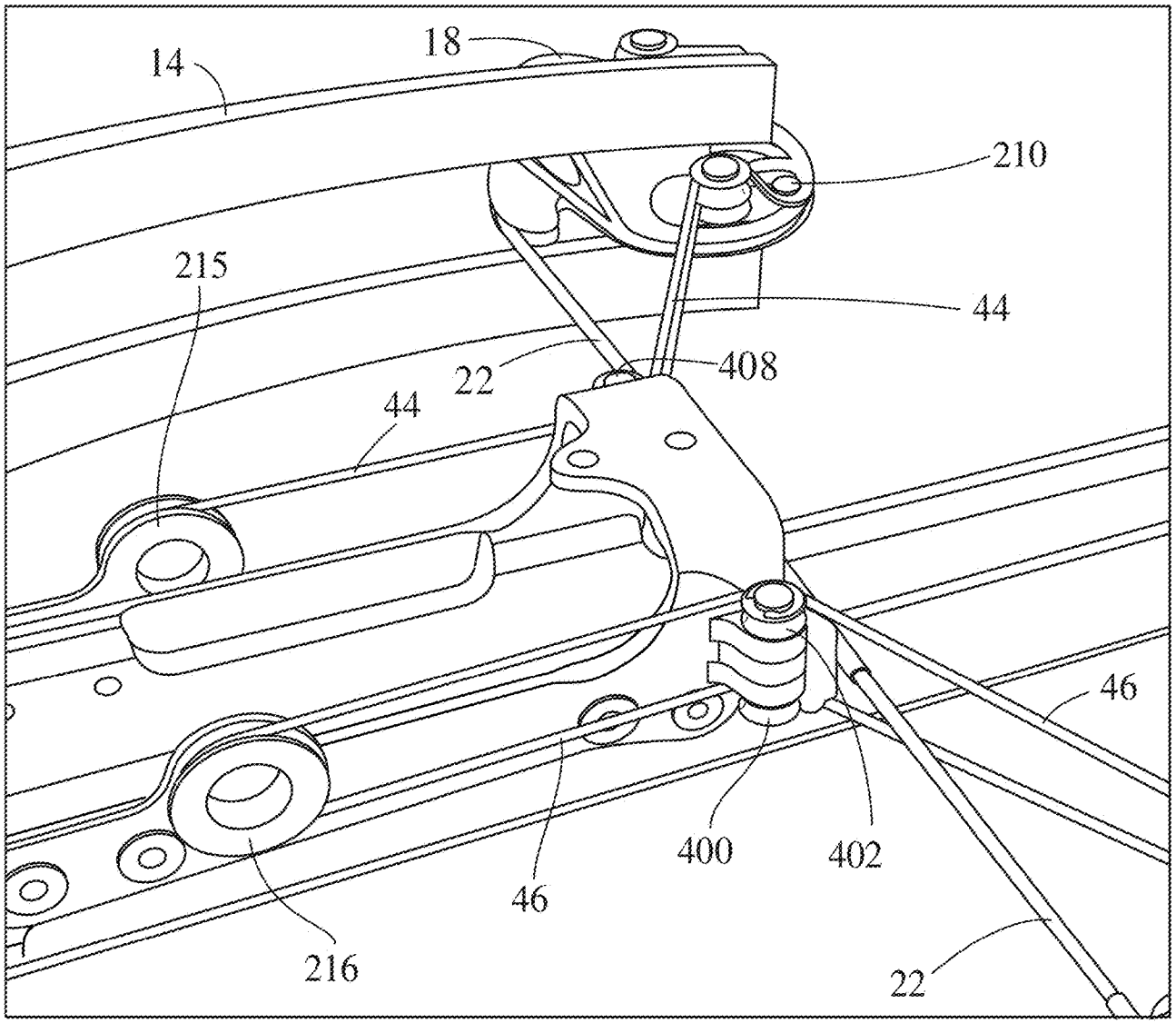
FIG. 2E is a partial view of the cable configuration of a crossbow of the present invention.

Referring specifically to FIGS. 2C, 2D, and 2E, a first end of a first cable 46 anchors to a first cam upper cable post 211, a segment of first cable 46 engages a first cable upper transition 402, said first cable 46 extends to and partially wraps a first pulley or hub 216, said first cable continues to and partially wraps a first cable lower transition 400, said first cable continues to said first cam 20 and second end of said first cable 46 anchors to first cam lower cable anchor not shown. A first end of a second cable 44 anchors to a second cam upper cable post 210, a segment of said second cable 44 engages a second cable upper transition 408, said second cable 44 extends to and partially wraps a second pulley or hub 215, said second cable continues to and partially wraps a second cable lower transition 404, said second cable continues to said second cam 18 and second end of said second cable 44 anchors to second cam lower cable anchor not shown.

Figure 3:
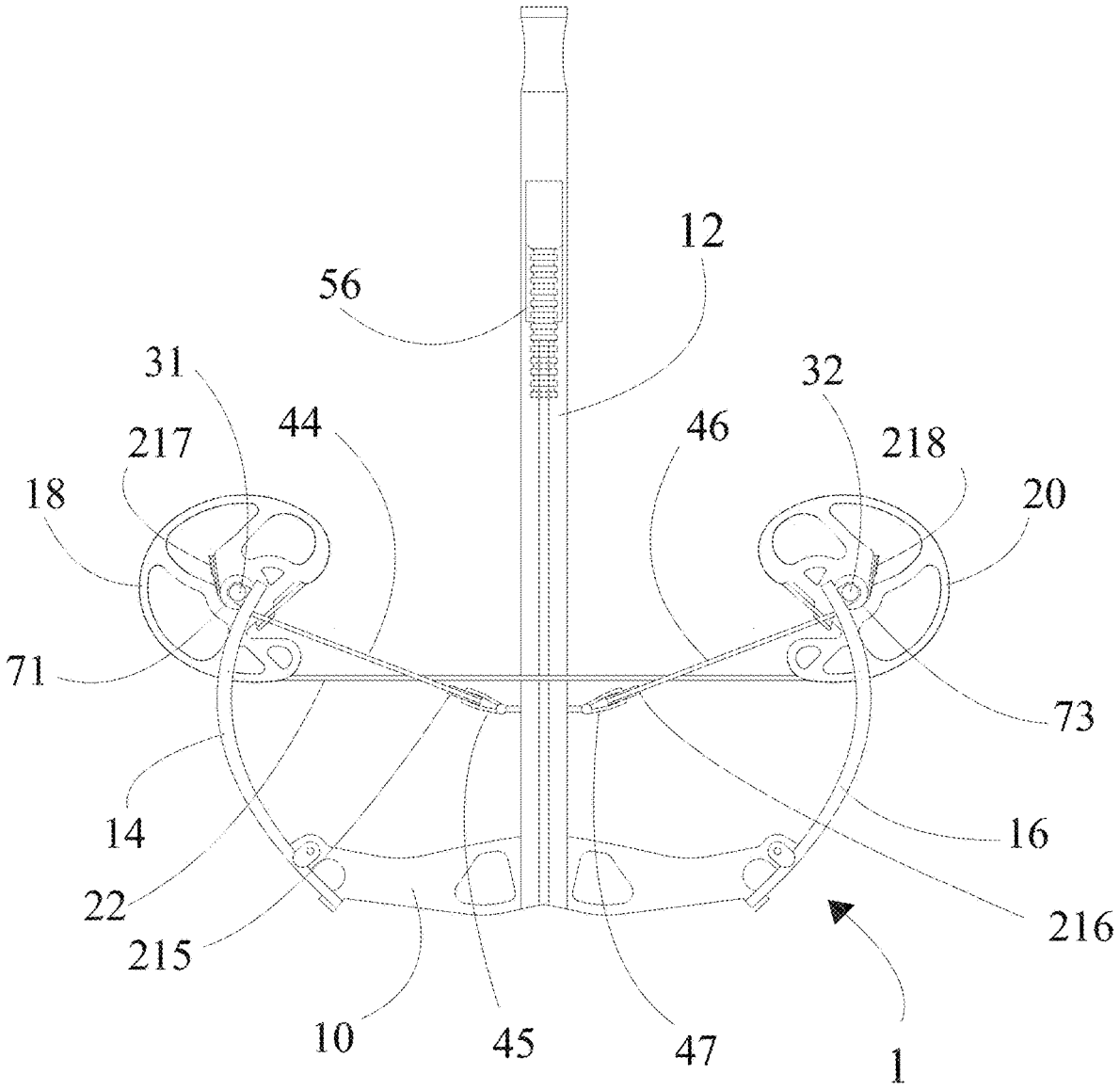
FIG. 3 is a top view of a conventional limb crossbow with inverted cams of the present invention in an at-rest position, having first and second cams; first and second cables; and a string, wherein opposing ends of the same cable are anchored to the same cam, and a mid-portion of the cables partially wrap a cable pulley.
Figure 3A:
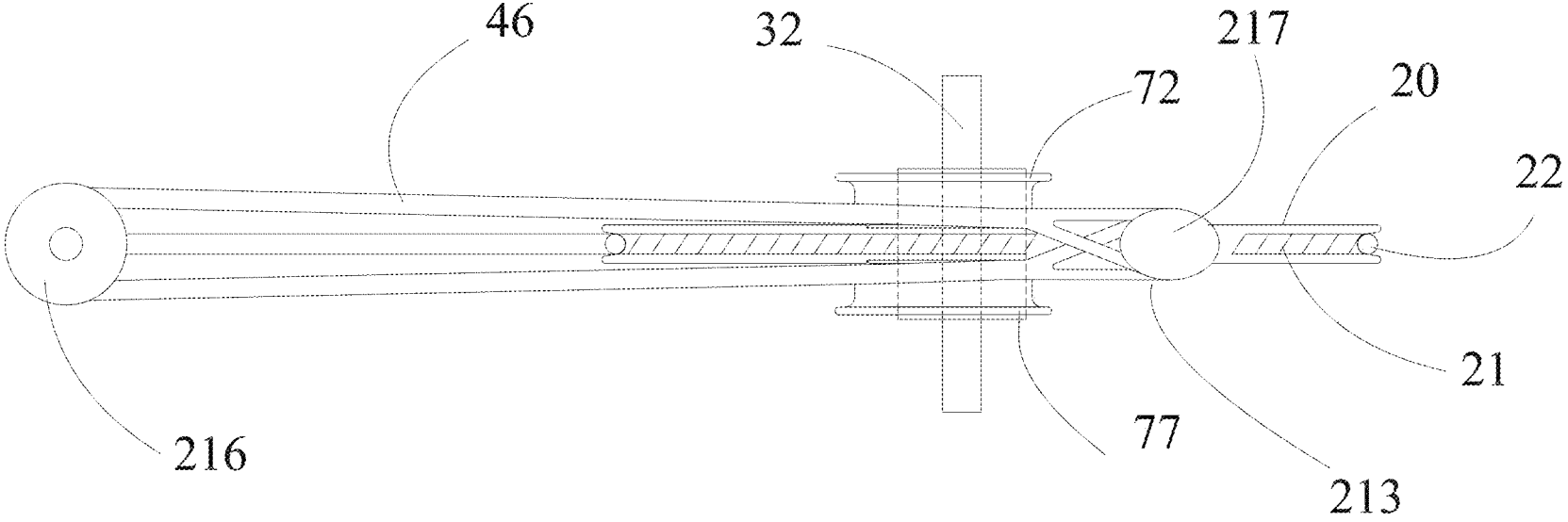
FIG. 3A is a side cut-away view of a second multi-piece cam with non-circular cable tracks of the present invention, having an upper and lower cable track that is at least twice as wide as the width of the cables; opposing ends of the second cable are anchored to the same post on the second cam, and a mid-portion of said second cable partially wraps a second cable pulley, a string and second cable are illustrated with the cam.

With reference to FIG. 3, a similar crossbow is shown as relates to FIG. 2, however the first and second ends of the first cable 44 are anchored to a first cam single cable post 217 on a first cam 18, and the first and second ends of the second cable 46 are anchored to a second cam single cable post 218 on the second cam 20. FIG. 3A shows a partial cross section view of the crossbow of FIG. 3, wherein the first and second ends of cable 46 are anchored to a first cam 18 first cam single cable post 217.

Referring to FIGS. 4A-4J, the first cam 18 includes a first launch string track 19, a first cam upper cable track 40, a first cam launch string post 61, and a first cam lower cable track 41. A first end of the launch string 22 is retained by the first cam launch string post 61; a portion of the span of the launch string 22 at least partially wraps around the first cam 18 in the first cam launch string track 19; a portion of the span of the launch string 22 at least partially wraps the second cam 20 in the second cam launch string track 21, and a second end of the bowstring 22 is retained by the second cam launch string post 63.

The first end of the first cable 44 is coupled to the first cam first cable post 210; a segment of the first cable 44 partially engages the first cam upper cable track 40; the middle of the first cable 44 is partially wraps first cable pulley 215 (not shown); a segment of the first cable 44 partially engages the first cam lower cable track 41; and the second end of the first cable 44 is coupled to the first cam second cable post 212. The first end of the second cable 46 is coupled to the second cam first cable post 211; a segment of the first cable 46 partially engages the second cam upper cable track 40; the middle of the first cable 46 is partially wraps second cable pulley 216 (not shown); a segment of the second cable 46 partially engages the second cam lower cable track 41; and the second end of the second cable 46 is coupled to the second cam second cable post 213.

Figure 6A:
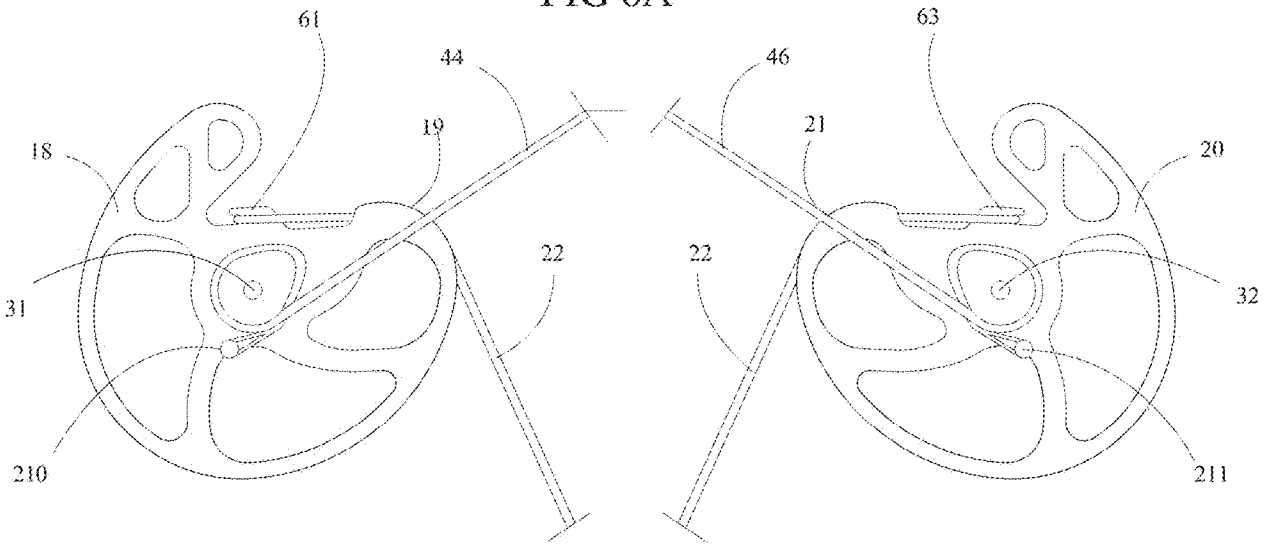
FIG. 6A is a top view of first and second multi-piece cams with non-circular cable tracks of the present invention; having an upper and lower cable track that is at least twice as wide as the width of the cables, modules have been removed for illustrative purposes; a string and cable are illustrated with the cam in a drawn position.
Figure 6B:
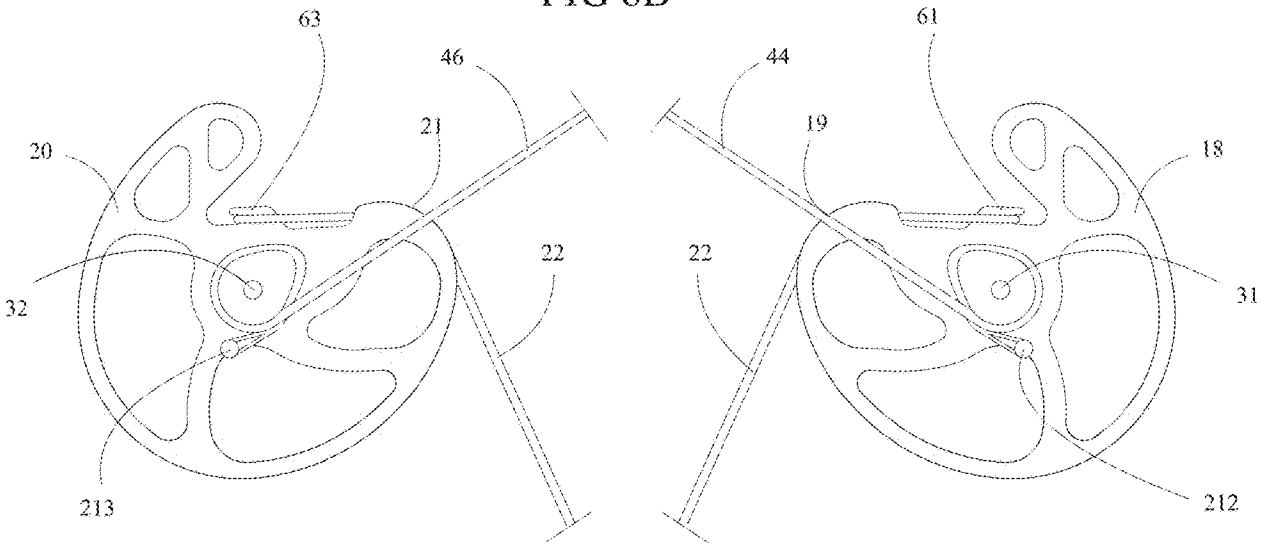
FIG. 6B is a bottom view of first and second multi-piece cams with non-circular cable tracks of the present invention, having an upper and lower cable track that is at least twice as wide as the width of the cables, modules have been removed for illustrative purposes; a string and cable are illustrated with the cam in a drawn position.
Figure 7A:
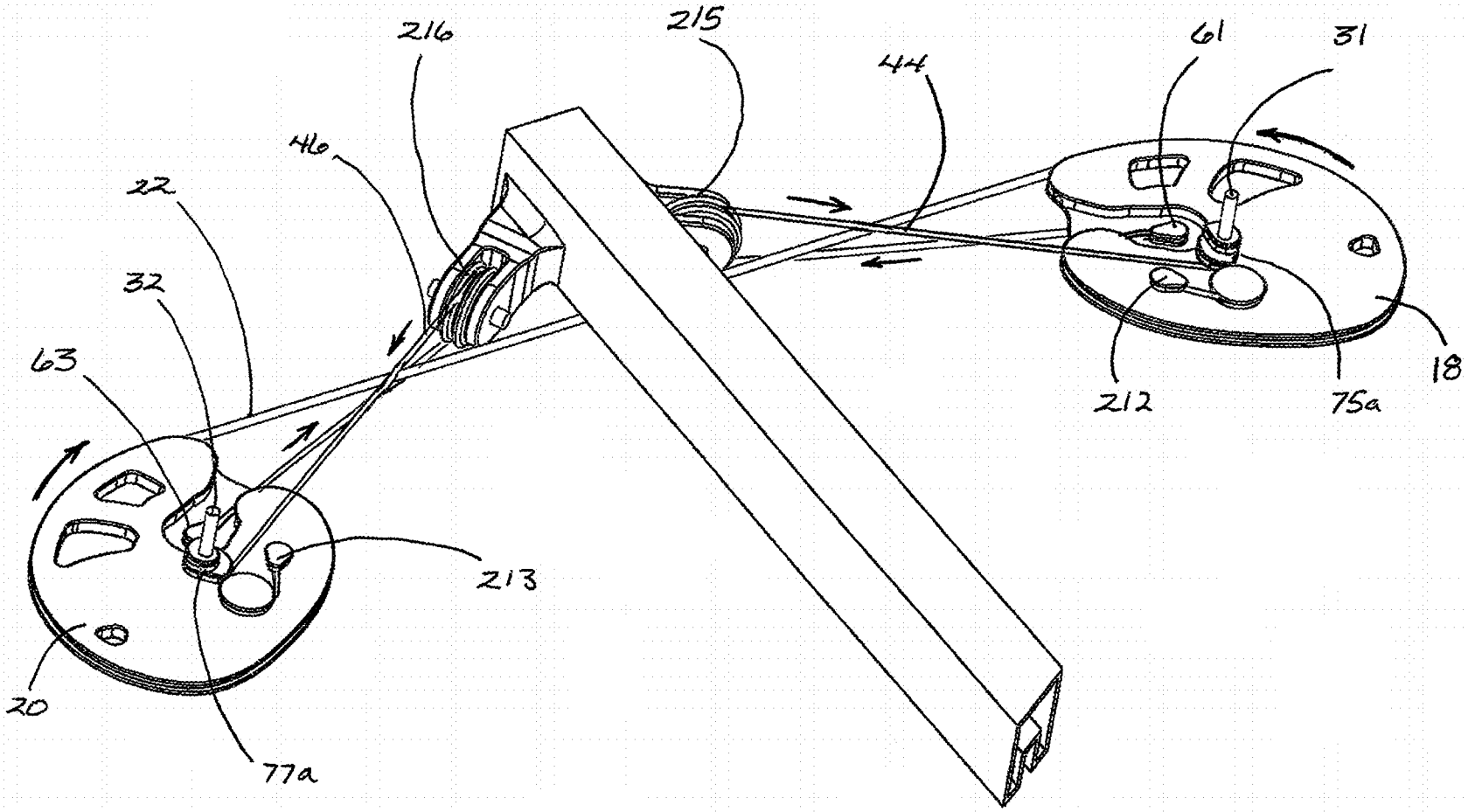
FIG. 7A is a partial bottom view of helical-style take-up cable track cam assembly of the present invention.
Figure 7B:
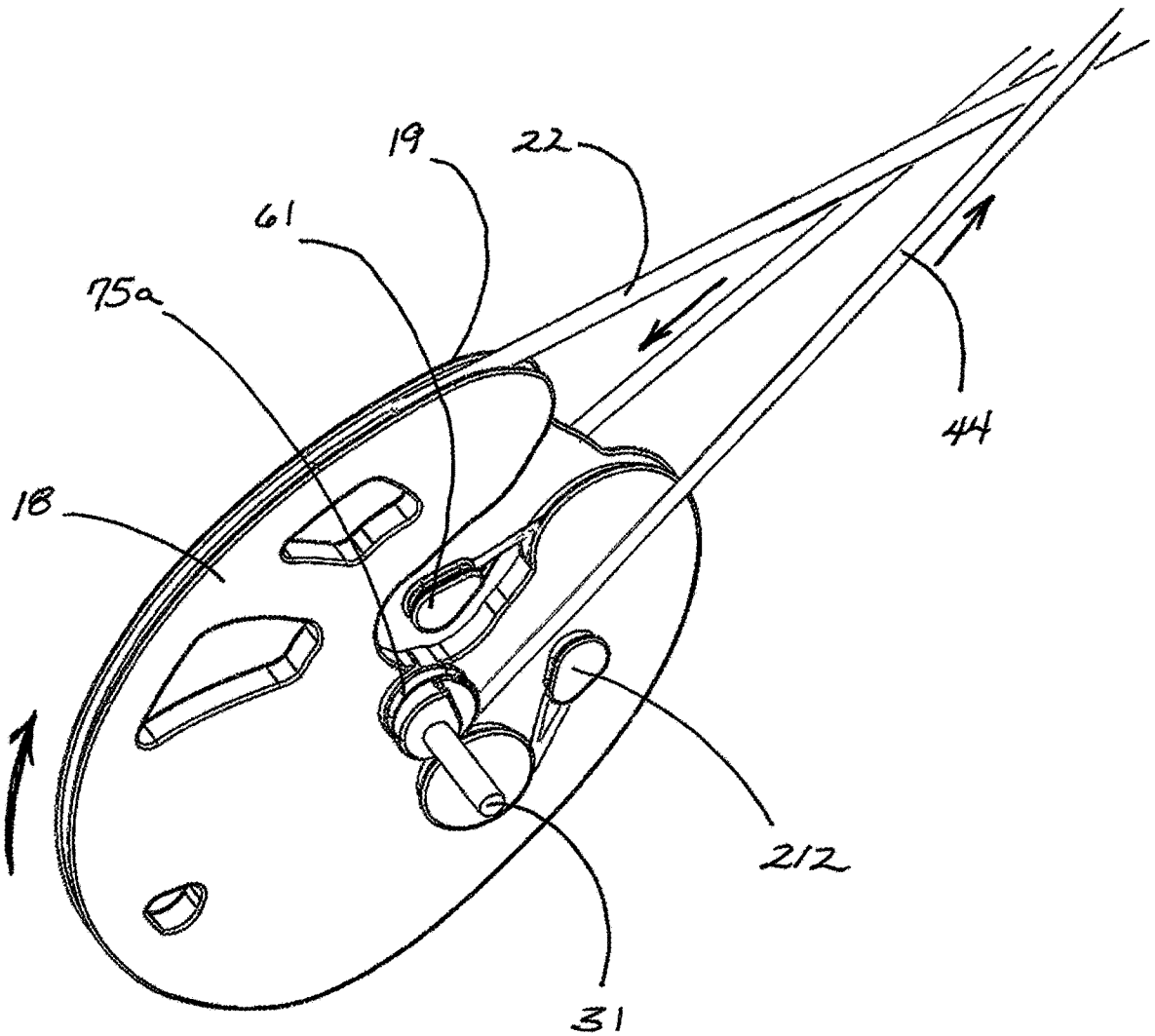
FIG. 7B is a partial bottom view of helical-style take-up cable track cam of the present invention.
Figure 8A:
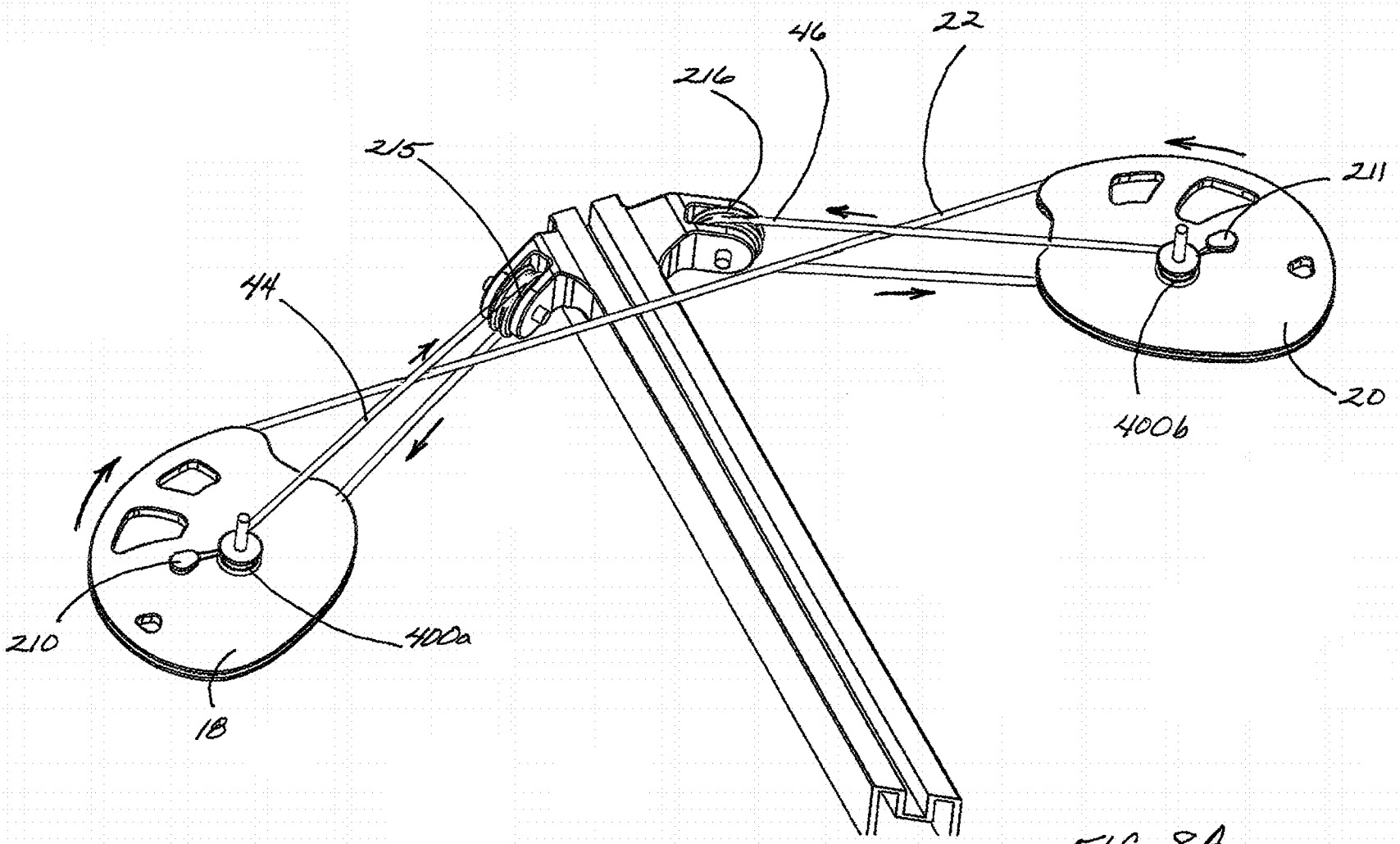
FIG. 8A is a partial top view of a 360 degree rotate-able payout cable track cam assembly of the present invention.
Figure 8B:
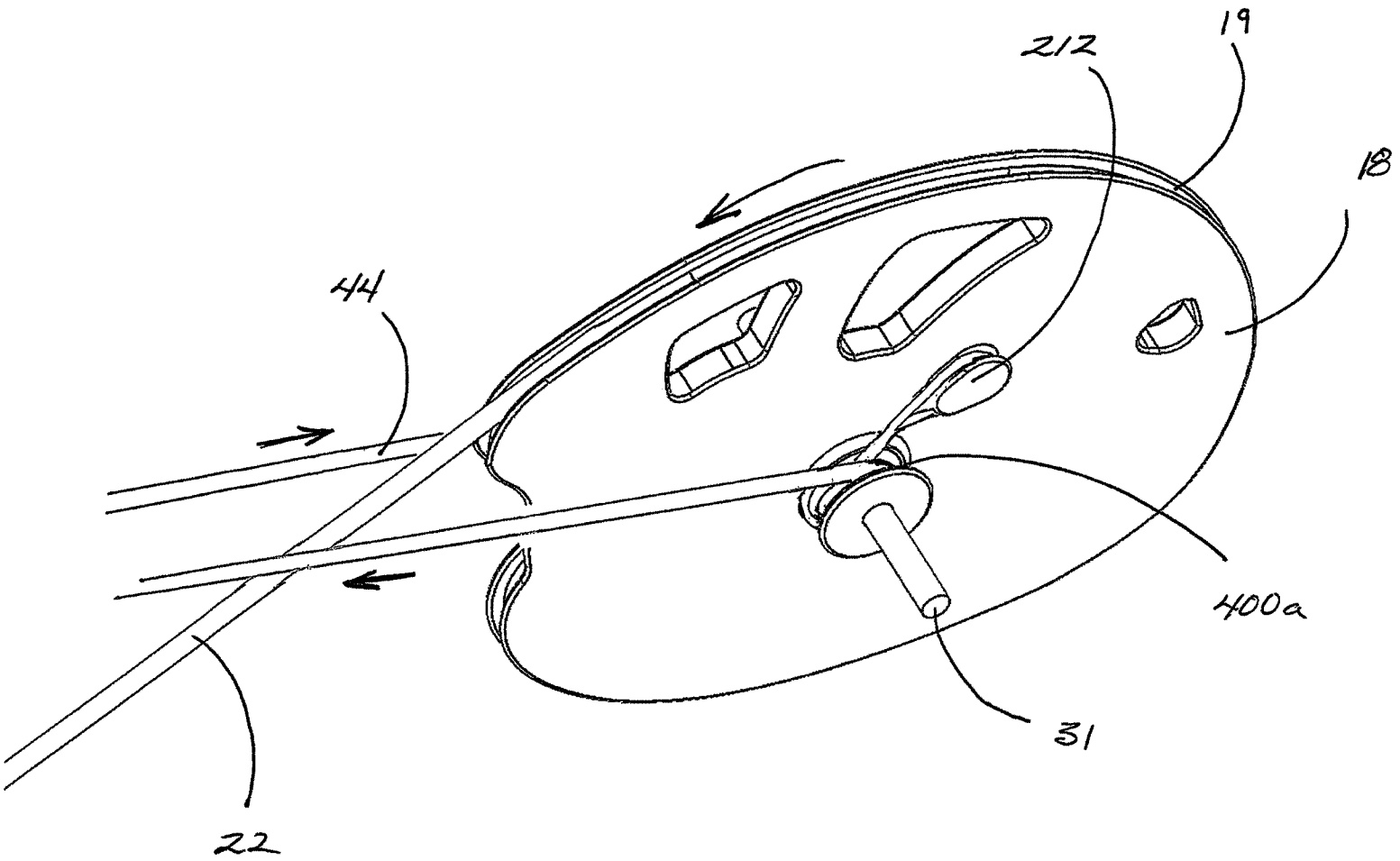
FIG. 8B is a partial top view of a 360 degree rotate-able payout cable track cam of the present invention.

With reference to FIGS. 6A and 6B, when the launch string 22 is drawn from a rest position to a ready to fire position, the first cam 18 rotates in a first direction, and the second cam 20 rotates in a second direction. As the cams 18 and 20 rotate, the launch string 22 is unwound from the first and second launch string tracks 19 and 21. Simultaneously, the cables 44 and 46 wind into the first and second upper cable tracks 40 and 42 and the first and second lower cable tracks 41 and 43 of the first 18 and second 20 cams. When the launch string 22 has been drawn to the ready-to-fire position, it may be held in this the position by an operably releasable catch located in a housing 56. The first cable 44 is slideable relative to the first cable pulley 215 and the second cable 46 is slideable relative to the second cable pulley 216.

The upper cable track 40, the lower cable track 41, the upper cable track 42 and the lower cable track 43 may be generally circular, or non-circular.

Figure 4A:
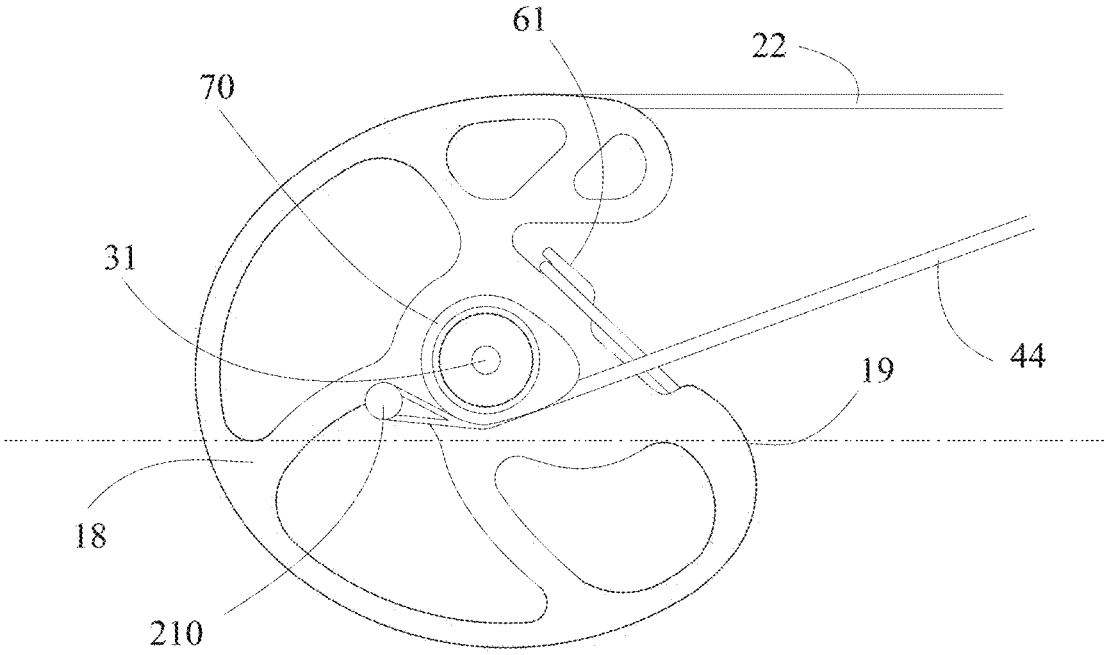
FIG. 4A is a top view of a first multi-piece cam with non-circular cable tracks of the present invention, a string and cable are illustrated with the cam.
Figure 4B:
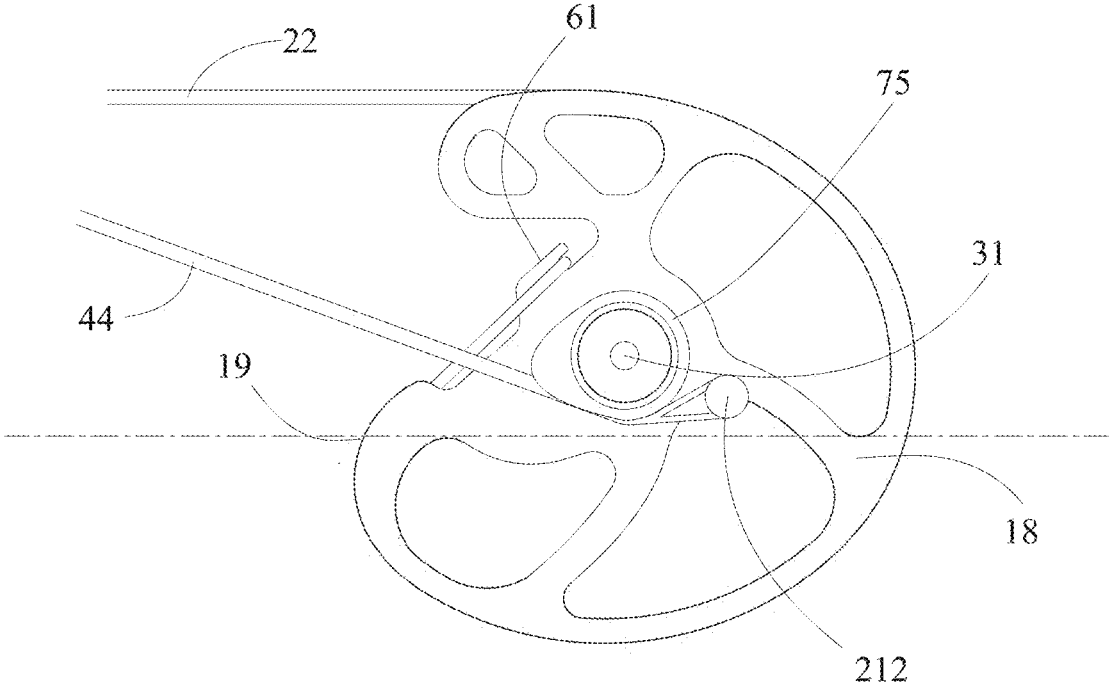
FIG. 4B is a bottom view of a first multi-piece cam with non-circular cable tracks of the present invention, a string and cable are illustrated with the cam.
Figure 4E:
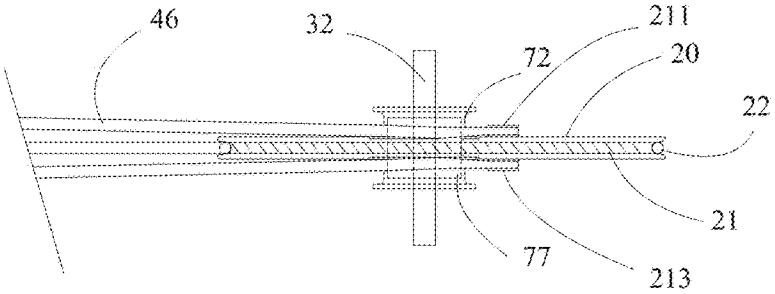
FIG. 4E is a side cut-away view of a second multi-piece cam with non-circular cable tracks of the present invention, having an upper and lower cable track that is at least twice as wide as the width of the cables, a string and cable are illustrated with the cam, wherein the cable does not anchor to the cam.
Figure 4F:
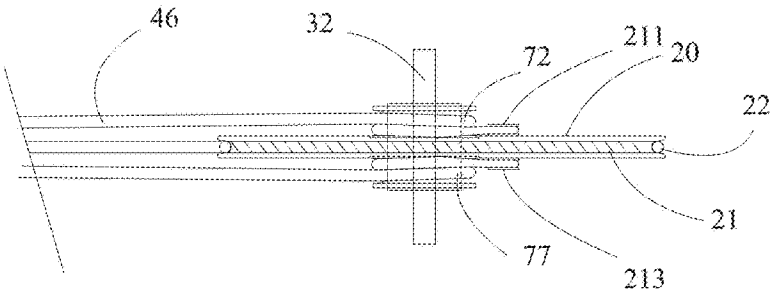
FIG. 4F is an exploded side view of a second multi-piece piece cam with non-circular cable tracks of the present invention having an upper and lower cable track that is at least twice as wide as the width of the cables, and having first and second mirror image modules.
Figure 4C:
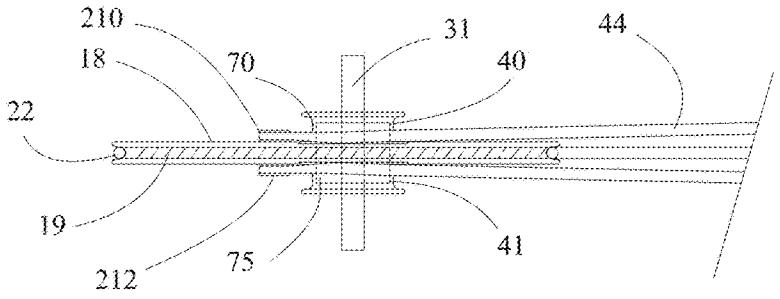
FIG. 4C is a side cut-away view of a first multi-piece cam with non-circular cable tracks of the present invention, having an upper and lower cable track that is at least twice as wide as the width of the cables, a string and cable are illustrated with the cam, wherein the cable does not anchor to the cam.
Figure 4D:
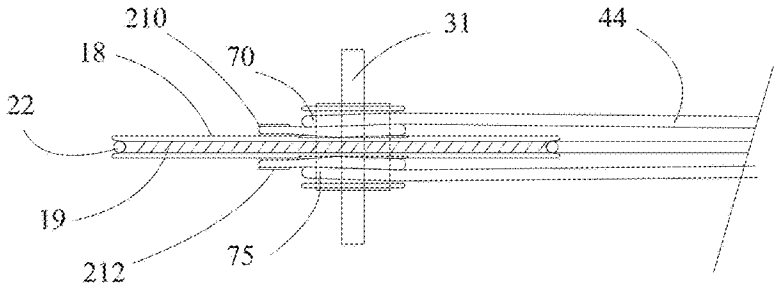
FIG. 4D is an exploded side view of a first multi-piece piece cam with non-circular cable tracks of the present invention having an upper and lower cable track that is at least twice as wide as the width of the cables, and having first and second mirror image modules.
Figure 4I:
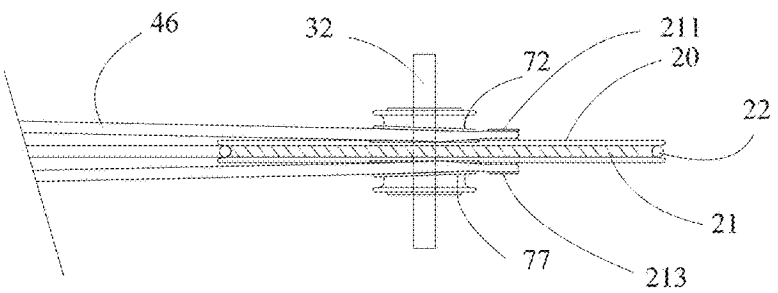
FIG. 4I is a side cut-away view of a second multi-piece cam with non-circular cable tracks of the present invention, having an upper and lower helical cable track, a string and cable are illustrated with the cam, wherein the cable does not anchor to the cam.
Figure 4J:
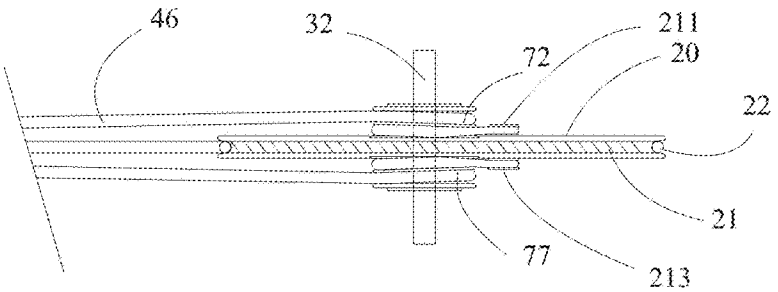
FIG. 4J is an exploded side view of a second multi-piece piece cam with non-circular cable tracks of the present invention having an upper and lower helical cable track, and having first and second mirror image modules.
Figure 4G:
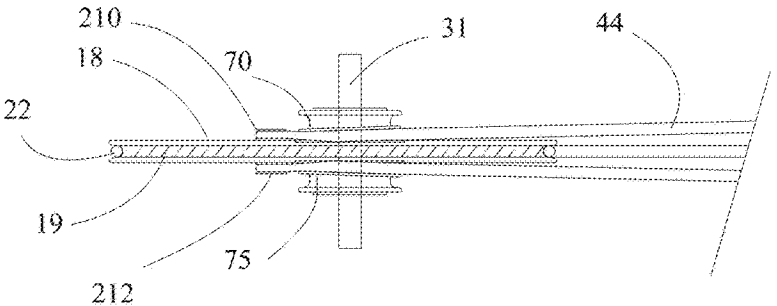
FIG. 4G is a side cut-away view of a first multi-piece cam with non-circular cable tracks of the present invention, having an upper and lower helical cable track, a string and cable are illustrated with the cam, wherein the cable does not anchor to the cam.
Figure 4H:
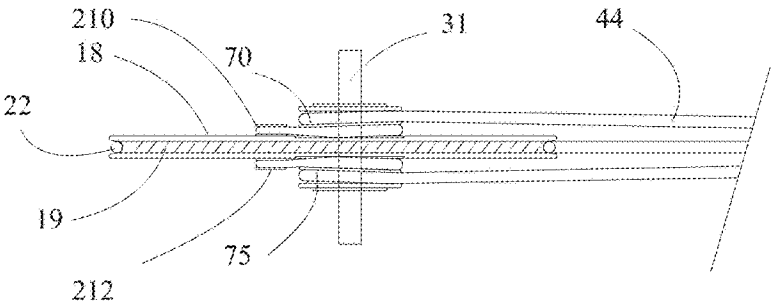
FIG. 4H is an exploded side view of a first multi-piece piece cam with non-circular cable tracks of the present invention having an upper and lower helical cable track, and having first and second mirror image modules.

FIGS. 4A-4D and 5A—5D illustrate an embodiment of the first cam 18 of the current invention with string and cable(s), wherein the first cam 18 is constructed of a modular type construction. In this type of construction, the first and second side of the first cam 18 and the second cam 20 are mirror images of each other, and the first cam 18 is identical and interchangeable with the second cam 20. The first cam 18 includes a first module 70 and a second module 75. The first and second modules 70, 75 are mirror images of each other. The first and second modules 70, 75 are identical and are interchangeable with a first module 72 and a second module 77 of the second cam 20. Specifically, FIG. 4A is a top view of the first cam 18, FIG. 4B is a bottom view of the first cam 18, FIG. 4C is a cut-away view of the first cam 18 with the string 22 and the cable 44. The first module 70 and the second module 75 may be generally non-circular, or circular.

FIGS. 4G-4J illustrate an alternate embodiment of the first cam 18 of the current invention with string and cable(s), wherein the first cam 18 is constructed of a modular type construction. In this type of construction, the first and second side of the first cam 18 and the second cam 20 are mirror images of each other, and the first cam 18 is identical and interchangeable with the second cam 20. The first cam 18 includes a first helical module 70 and a second helical module 75. The first and second helical modules 70, 75 are mirror images of each other. The first and second helical modules 70, 75 are identical and are interchangeable with a first module 72 and a second module 77 of the second cam 20.

Figure 5A:
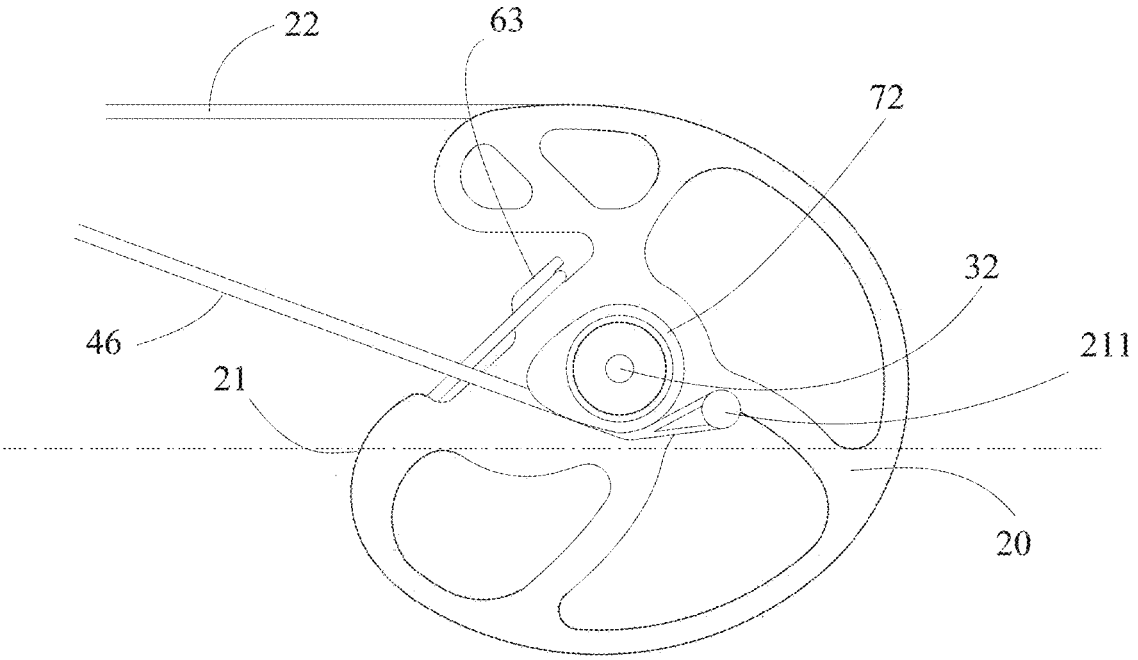
FIG. 5A is a top view of a second multi-piece cam with non-circular cable tracks of the present invention, a string and cable are illustrated with the cam.
Figure 5B:
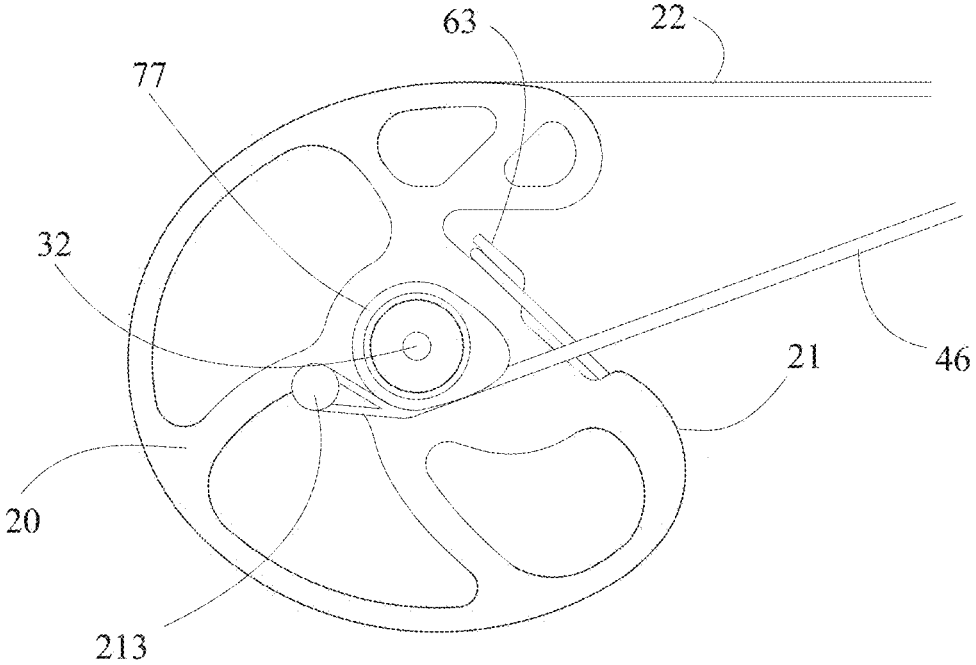
FIG. 5B is a bottom view of a second multi-piece cam with non-circular cable tracks of the present invention, a string and cable are illustrated with the cam.
Figure 5C:
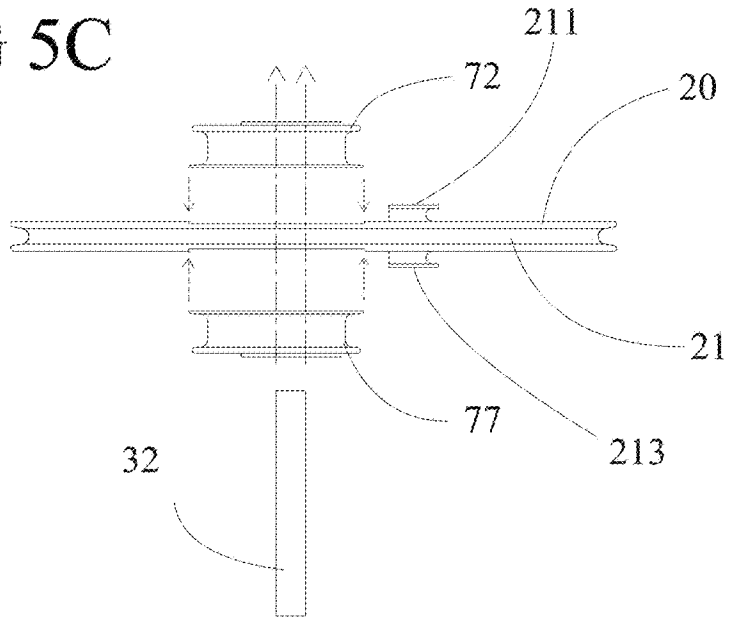
FIG. 5C is an exploded side view of a second multi-piece piece cam with non-circular cable tracks of the present invention having an upper and lower cable track that is at least twice as wide as the width of the cables, and having a first and second mirror image modules.
Figure 5D:
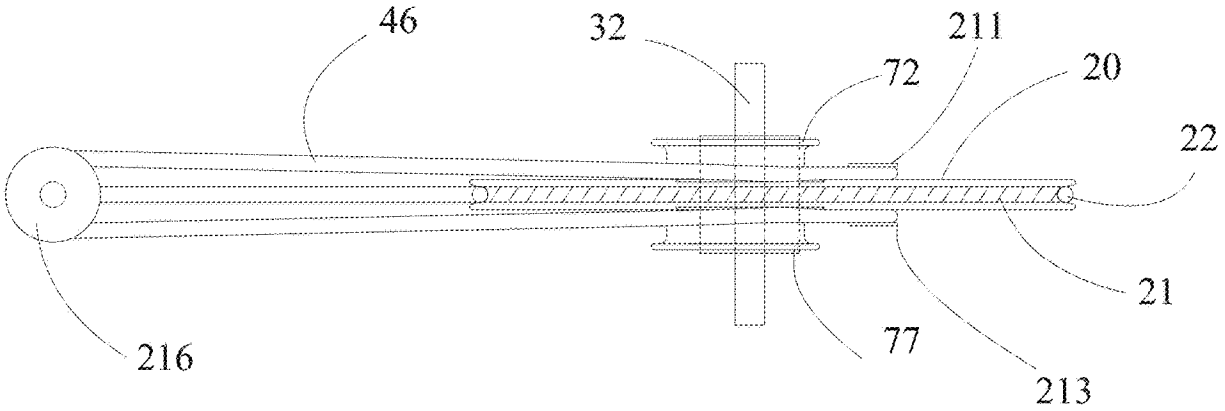
FIG. 5D is a side cut-away view of a second multi-piece cam with non-circular cable tracks of the present invention, having an upper and lower cable track that is at least twice as wide as the width of the cables; opposing ends of the second cable are anchored to the second cam, and a mid-portion of said second cable partially wraps a second cable pulley, a string and second cable are illustrated with the cam.
Figure 5E:
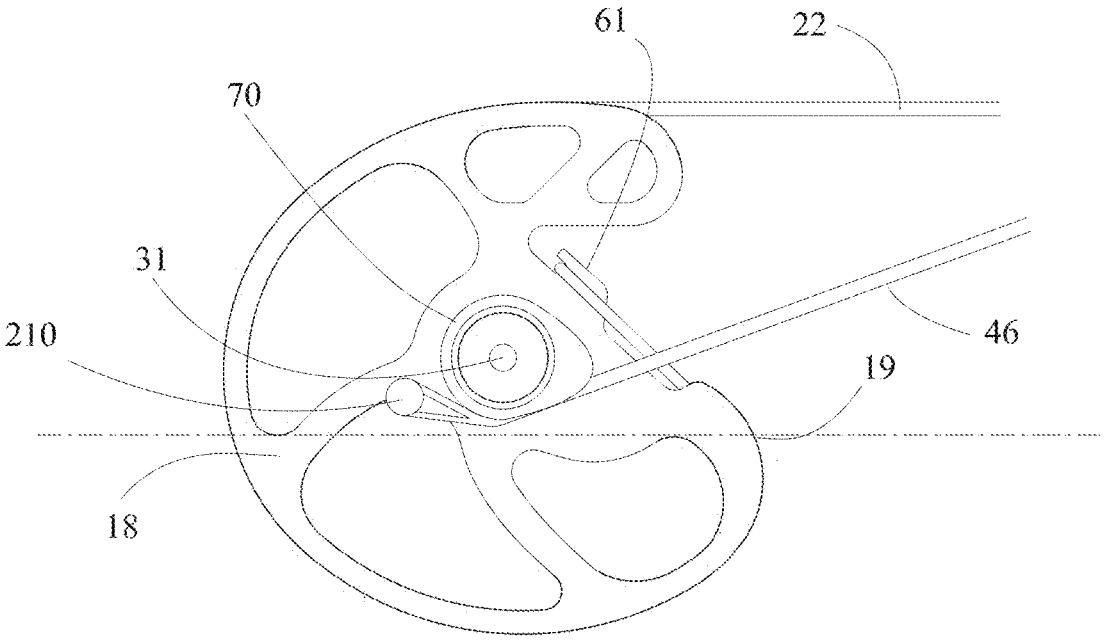
FIG. 5E is a top view of a first multi-piece cam with non-circular cable tracks of the present invention, a string and cable are illustrated with the cam.
Figure 5F:
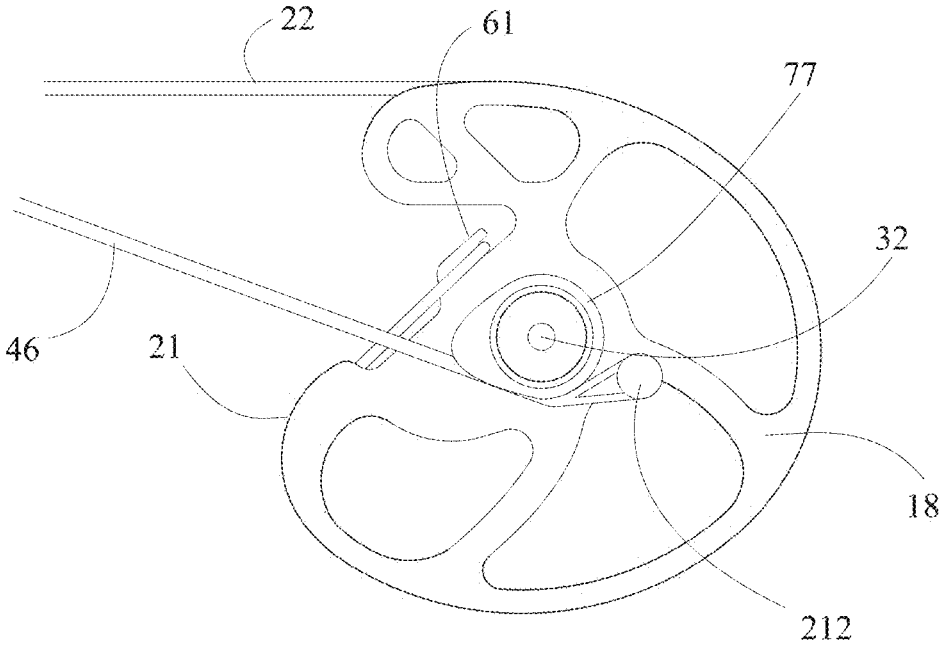
FIG. 5F is a bottom view of a first multi-piece cam with non-circular cable tracks of the present invention, a string and cable are illustrated with the cam.
Figure 5G:
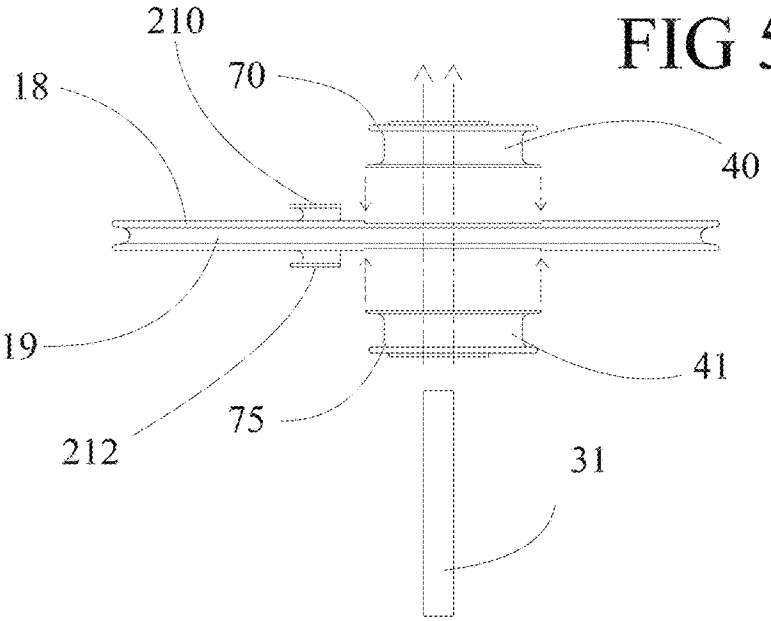
FIG. 5G is an exploded side view of a first multi-piece piece cam with non-circular cable tracks of the present invention having an upper and lower cable track that is at least twice as wide as the width of the cables, and having a first and second mirror image modules.
Figure 5H:
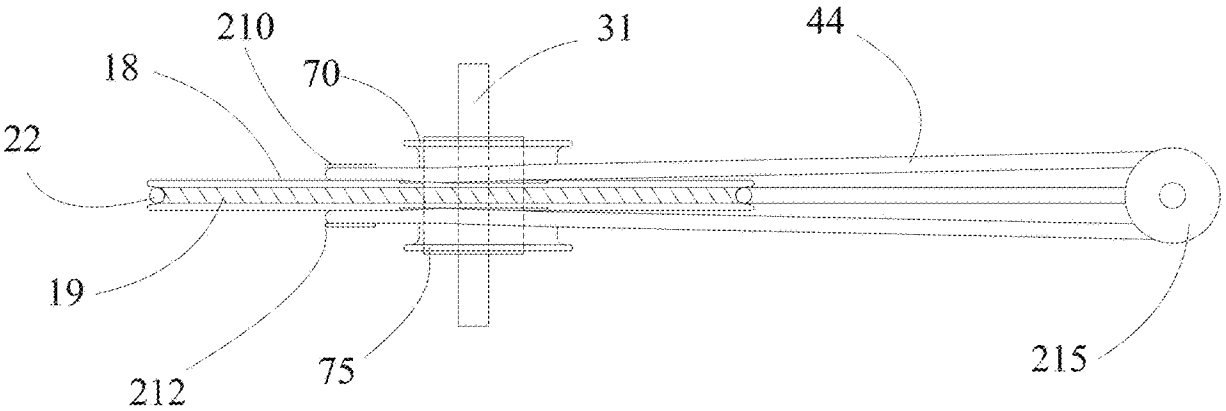
FIG. 5H is a side cut-away view of a first multi-piece cam with non-circular cable tracks of the present invention, having an upper and lower cable track that is at least twice as wide as the width of the cables; opposing ends of the first cable are anchored to the first cam, and a mid-portion of said first cable partially wraps a first cable pulley, a string and first cable are illustrated with the cam.

FIGS. 5A-5D illustrate an embodiment of the second cam 20 of the current invention, with string and cable(s), wherein the second cam 20 is constructed of a modular type construction. In this type of construction, the first and second side of the second cam 20 and the first cam 18 are mirror images of each other, and the first cam 18 is identical and interchangeable with the second cam 20. The first module 72 and the second module 77 are mirror images of each other, and the first and second modules 70 and 75 are identical and interchangeable with the first and second modules 72 and 77. Specifically, FIG. 5A is a top view of the second cam 20, FIG. 5B is a bottom view of the second cam 20, FIG. 5C is a cut-away view of a second cam with the string 22 and the cable 46. The first module 72 and the second cable module 77 may be generally non-circular, or circular. FIG. 6A illustrates a top view of the first cam 18 and the second cam 20, in the drawn position. FIG. 6B illustrates a bottom view of the first cam 18 and the second cam 20, in the drawn position. FIGS. 6A and 6B are identical to each other and not just mirror images, as described previously in FIGS. 5A-5D. This feature allows for an easier method of manufacture and assembly.

A first end of the launch string 22 is anchored to the first cam string post 61; a segment of the launch string 22 partially wraps cam 18 in the string track 19; the string crosses the center of the riser 10; and partially wraps the second cam 20 in the string track 21; and the second end of the launch string 22 is anchored to the second cam string post 63.

With reference to FIGS. 4A-4D and 5A—5D, the center of the first and second cables 44, 46 slideably engage the first and second cable pulleys 215 and 216, which allows the first and second cables 44, 46 to "self-center" themselves relative to a first side and a second side of the first and second cams 18 and 20. The self-centering feature of the cables 44, 46 provides for automatic cable timing, which eliminates cam lean, and timing issues. As the launch string 22 is drawn, the launch string unwraps, or "pays out" from the first and second cams 18, 20. Simultaneously, the first and second cables 44, 46 wrap the respective first cable tracks 70, 75 and the second cable tracks 72, 77.

With reference to FIGS. 7A, 7B, 8A, and 8B, a helical-style cable take-up track is disclosed, wherein the cams may rotate up to, and more than 360 degrees. A first end of the first cable 44 is anchored to a first cam first cable post 212, a segment of the first cable 44 wraps the first cam payout cable track 400*a* and spans to and partially wraps a first pulley 215, the cable 44 then spans to and at least partially wraps a first cam take-up cable track 75*a*, and the second end of the first cable 44 anchors to a first cam second cable post 210. A first end of the second cable 46 is anchored to a second cam first cable post 213, a segment of the second cable 46 wraps the second cam payout cable track 400*b* and spans to and partially wraps a second pulley 216, the second cable 46 then spans to and at least partially wraps a second cam take-up cable track 77*a*, and the second end of the second cable 46 anchors to a second cam second cable post 213.

Figure 9A:
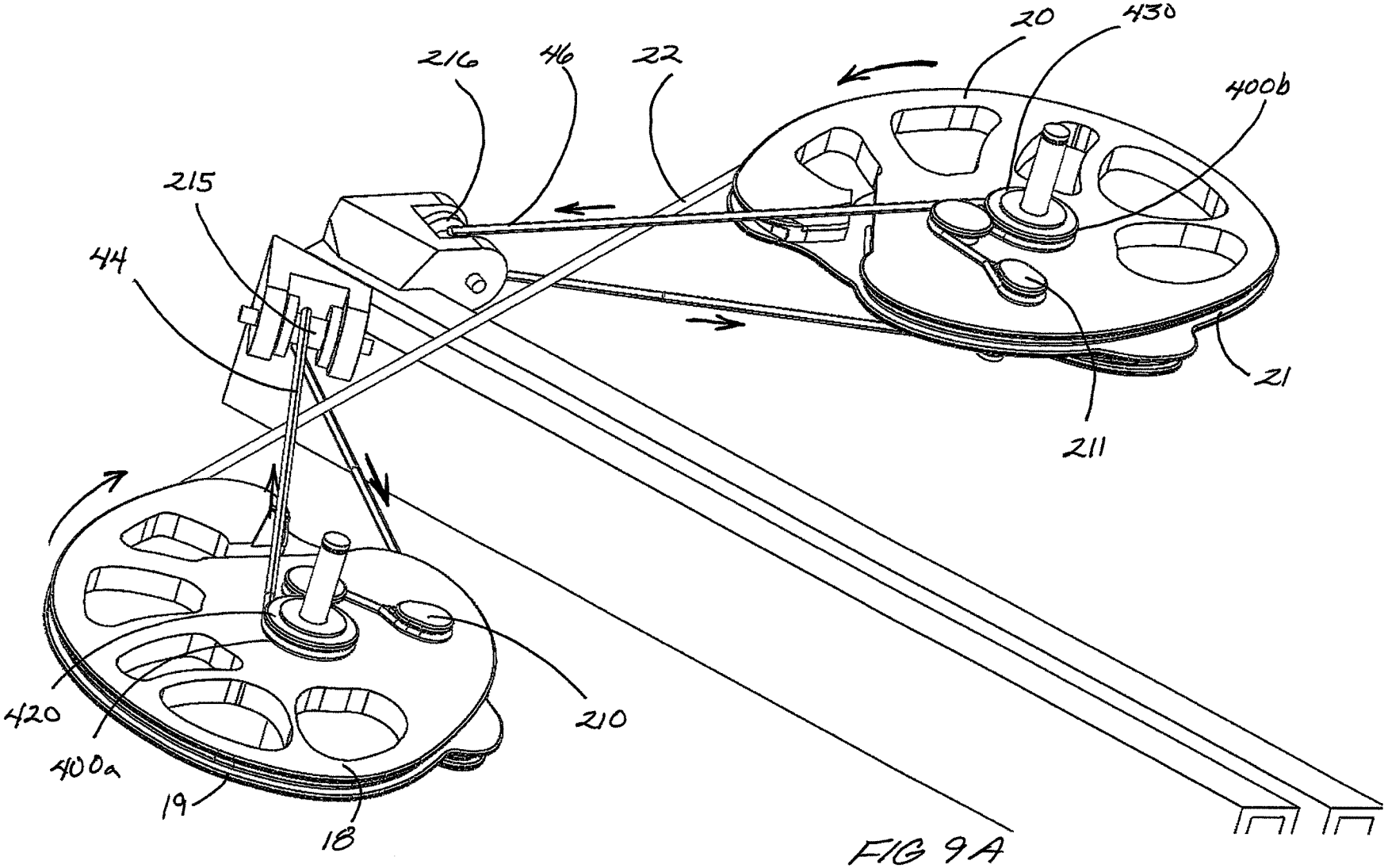
FIG. 9A is a partial top view of a 270 degree rotate-able cable track cam assembly of the present invention.
Figure 9B:
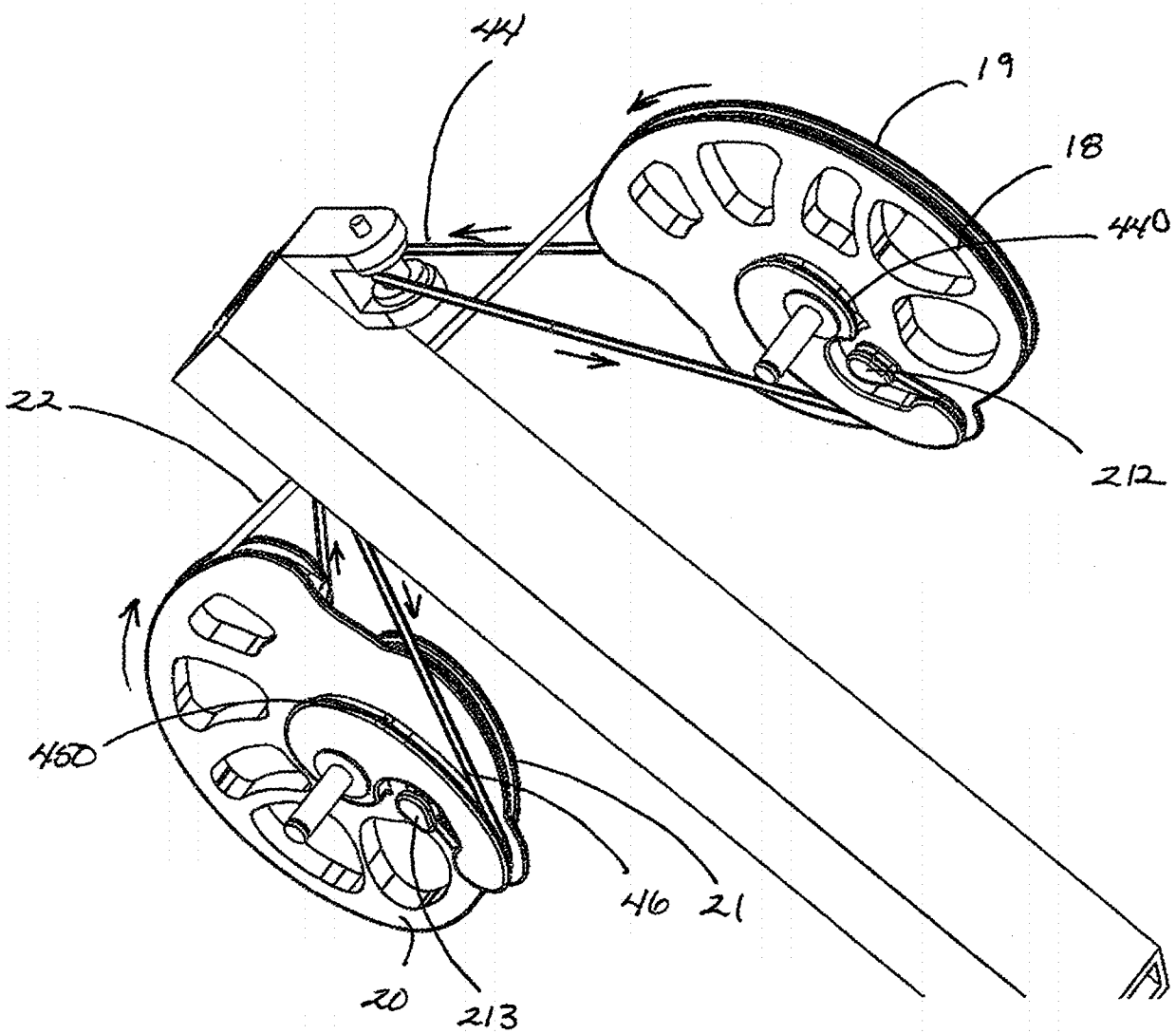
FIG. 9B is a partial bottom view of a take-up cable track cam assembly of the present invention.

With reference to FIGS. 9A and 98, a conventional cable take-up track having a let off wherein the cams rotate about 270 degrees is disclosed. A first end of the first cable 44 is anchored to a first cam first cable post 210, a segment of the first cable 44 partially wraps the first cam payout cable track 400*a* and spans to and partially wraps a first pulley 215, the first cable 44 then spans to and at least partially wraps a first cam take-up cable track 440, and the second end of the first cable 44 anchors to a first cam second cable post 212. A first end of the second cable 46 is anchored to a second cam first cable post 211, a segment of the second cable 46 partially wraps the second cam payout cable track 400*b* and spans to and partially wraps a second pulley 216, the second cable then spans to and at least partially wraps a second cam take-up cable track 450, and the second end of the second cable 46 anchors to a second cam second cable post 213. FIG. 9A illustrates a first payout track 400*a* and a second payout track 400*b* that may be the perimeter of a wheel, post, or module numbered 420 and 430. When manufactured as modules, the first payout module 420 and second module 430 will be of equal size and shape, preferably round. Manufactured as modules, multiple sizes (perimeters) may be interchangeable used to adjust the peak draw force and LTM/A-AM of the bow assembly, so long as equal sized modules are used together.

The cams 18 and 20 have string tracks 19 and 21, a first cable payout track on a first side of the string track, and a first cable take-up track on the second side of the string track. A first cam 18 is journaled on a first side of a bow center-line, and a second cam 20 is journaled on a second side of a bow center-line. A first end of a bowstring 22 is anchored to the first cam 18, a segment of the bowstring 22 at least partially wraps the first cam string track 19 and spans to the second cam 20, a segment of the bowstring 22 at least partially wraps the second cam string track 21, and a second end of the bowstring 22 is anchored to the second cam 20. A first end of a first cable 44 is anchored to a first cable post 210 on the first cam, a payout segment of the first cable 44 at least partially wraps the payout cable track 400*a* of the first cam 18, the cable spans to and at least partially wraps the first pulley or hub 215, then the first cable 44 spans to at least partially engage the first cable take-up track 440 of the first cam 18, and the second end of the first cable 44 is anchored to a second cable post 212 on the first cam 18.

A first end of a second cable 46 is anchored to a first cable post 211 on the second cam 20, a payout segment of the second cable 46 at least partially wraps the payout cable track 400*b* of the second cam 20, the second cable 46 spans to and at least partially wraps the second pulley or hub 216, the second cable 46 spans to at least partially engage the second cable take-up track 450 of the second cam 20, and the second end of the second cable 46 is anchored to a second cable post 213 on the second cam 20. In a preferred embodiment, the cables do not cross the center line of the bow, however in an alternative embodiment, the cables may cross the center line of the bow. The perimeter of the payout cable track must be sized smaller than the perimeter of the cable take-up track.

Unique to the present invention, as the bowstring 22 is pulled, the cams 18 and 20 oppositely rotate a first direction unwinding the bowstring 22 from the bowstring tracks 19 and 21, the cable payout tracks unwinds cable (pays out) and the cable take-up track winds the cable, creating increased energy in the limbs or springs, and is also known as limb tip movement.

In certain embodiments, the cams may be designed having zero let-off, or any amount of desired let-off. The cams may be designed having no adjustability for draw length modules, or may have draw length adjustability modules. The cams may have cable tracks more or less parallel to the string track, not parallel to the string track, or helical about the axis of the cam axle. The cams may be journaled with the limbs, tubes, or springs (non-stationary), or the limbs may be journaled with the frame (stationary) wherein the cables interact with the limbs.

It is preferable that the second ends of the first and second cables 44 and 46 not be anchored to the same post. However the first and second cables 44 and 46 will still function satisfactorily if anchored to the same post.

While the preferred embodiment of the invention has been illustrated and described, it will be obvious to those skilled in the art that changes and modifications may be made without departing from the invention in its broader aspects, and therefore, the aim in the appended claims is to cover all such changes and modifications as fall within the true spirit and scope of the invention. Though the term "pulley" has been used to reference the component used to slide-ably retain and transition the cables from above the bowstring track to below the bowstring track, any component fulfilling the same function may be utilized and may or may not be referred to as a pulley, and may or may not function as a rotate-able pulley, as rotation of the component is not a prerequisite to retention and transition of said the cables.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A projectile launching device comprising:

a first 3-track cam and a second 3-track cam capable of being coupled by a bowstring, said first and second 3-track cams have a cable payout track, a middle bowstring track, and a cable take-up track, an outer perimeter of said cable take-up track is greater in length than an outer perimeter of said cable payout track, a first and second cable, each cable having a first end and a second end, and a first and second cable pulley, said cable payout tracks on a first side of said bowstring track, said cable take-up tracks on a second side of said bowstring track, said first 3-track cam and said second 3-track cam are mirror images of each other, a first end of said first cable anchored to said first cam, a segment of said first cable wraps said first cable payout track, a mid-section of said first cable partially wrap said first cable pulley, a segment of said first cable engages said first cable take-up track, and the second end of said first cable is anchored to said first cam; a first end of said second cable anchored to said second cam, a segment of said second cable wraps said second cable payout track, a mid-section of said second cable partially wrap said second cable pulley, a segment of said second cable engages said second cable take-up track, and the second end of said second cable is anchored to said second cam.

2. The projectile launching device of claim 1 wherein:
a first end of a bowstring is anchored to said first 3-track cam and a second end of the bowstring is anchored to said second 3-track cam.

3. The projectile launching device of claim 1 wherein:
said first cable is slide-ably engaged with said first cable pulley, said second cable is slide-ably engaged with said second cable pulley.

4. The projectile launching device of claim 1 wherein:
said first cable payout track is a first cable payout track module, said second cable payout track is a second cable payout track module.

5. The projectile launching device of claim 1 wherein:
said projectile launching device is a crossbow.

6. The projectile launching device of claim 1 wherein:
said first and second pulleys are located at a front end of a barrel of said projectile launching device.

7. A projectile launching device comprising:
a first 3-track cam and a second 3-track cam capable of being coupled by a bowstring, said first and second 3-track cams have a cable payout track, a middle bowstring track, and a cable take-up track, a first and second cable, each cable having a first end and a second end, and a first and second cable pulley, a take-up distance between said take-up cable track and an axle of said pulley is greater than a payout distance between said payout cable track and said axle, said cable payout tracks on a first side of said bowstring track, said cable take-up tracks on a second side of said bowstring track, said first 3-track cam and said second 3-track cam are mirror images of each other, a first end of said first cable anchored to said first cam, a segment of said first cable wraps said first cable payout track, a mid-section of said first cable partially wrap said first cable pulley, a segment of said first cable engages said first cable take-up track, and the second end of said first cable is anchored to said first cam; a first end of said second cable anchored to said second cam, a segment of said second cable wraps said second cable payout track, a mid-section of said second cable partially wrap said second cable pulley, a segment of said second cable engages said second cable take-up track, and the second end of said second cable is anchored to said second cam.

8. The projectile launching device of claim 7 wherein:
a first end of a bowstring is anchored to said first 3-track cam and a second end of the bowstring is anchored to said second 3-track cam.

9. The projectile launching device of claim 7 wherein:
said first cable is slide-ably engaged with said first cable pulley, said second cable is slide-ably engaged with said second cable pulley.

10. The projectile launching device of claim 7 wherein:
said first cable payout track is a first cable payout track module, said second cable payout track is a second cable payout track module.

11. The projectile launching device of claim 7 wherein:
said projectile launching device is a crossbow.

12. The projectile launching device of claim 7 wherein:
said first and second pulleys are located at a front end of a barrel of said projectile launching device.

13. A projectile launching device comprising:
a first 3-track cam and a second 3-track cam capable of being coupled by a bowstring, said first and second 3-track cams have a cable payout track, a middle bowstring track, and a cable take-up track, an outer perimeter of said cable take-up track is greater in length than an outer perimeter of said cable payout track, a first and second cable, each cable having a first end and a second end, and a first and second cable pulley, a take-up distance between said take-up cable track and an axle of said pulley is greater than a payout distance between said payout cable track and said axle, said cable payout tracks on a first side of said bowstring track, said cable take-up tracks on a second side of said bowstring track, said first 3-track cam and said second 3-track cam are mirror images of each other, a first end of said first cable anchored to said first cam, a segment of said first cable wraps said first cable payout track, a mid-section of said first cable partially wrap said first cable pulley, a segment of said first cable engages said first cable take-up track, and the second end of said first cable is anchored to said first cam; a first end of said second cable anchored to said second cam, a segment of said second cable wraps said second cable payout track, a mid-section of said second cable partially wrap said second cable pulley, a segment of said second cable engages said second cable take-up track, and the second end of said second cable is anchored to said second cam.

14. The projectile launching device of claim 13 wherein:
a first end of a bowstring is anchored to said first 3-track cam and a second end of the bowstring is anchored to said second 3-track cam.

15. The projectile launching device of claim 13 wherein:
said first cable is slide-ably engaged with said first cable pulley, said second cable is slide-ably engaged with said second cable pulley.

16. The projectile launching device of claim 13 wherein:
said first cable payout track is a first cable payout track module, said second cable payout track is a second cable payout track module.

17. The projectile launching device of claim 13 wherein:
said projectile launching device is a reverse style crossbow.

18. The projectile launching device of claim 13 wherein:
said first and second pulleys are located at a front end of a barrel of said projectile launching device.

* * * * *